US010481514B2

(12) United States Patent
Mori et al.

(10) Patent No.: US 10,481,514 B2
(45) Date of Patent: Nov. 19, 2019

(54) IMAGE FORMING APPARATUS AND IMAGE FORMING METHOD

(71) Applicants: Atsushi Mori, Tokyo (JP); Hideo Muroi, Kanagawa (JP); Makoto Komatsu, Kanagawa (JP); Shinji Kato, Kanagawa (JP)

(72) Inventors: Atsushi Mori, Tokyo (JP); Hideo Muroi, Kanagawa (JP); Makoto Komatsu, Kanagawa (JP); Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/054,397

(22) Filed: Aug. 3, 2018

(65) Prior Publication Data

US 2019/0049872 A1 Feb. 14, 2019

(30) Foreign Application Priority Data

Aug. 10, 2017 (JP) ..... 2017-156162

(51) Int. Cl.
*G03G 15/00* (2006.01)
*G03G 15/01* (2006.01)
(Continued)

(52) U.S. Cl.
CPC ..... *G03G 15/0126* (2013.01); *G03G 15/0806* (2013.01); *G03G 15/0855* (2013.01);
(Continued)

(58) Field of Classification Search
CPC ..... G03G 15/5041; G03G 15/5058; G03G 15/5037
See application file for complete search history.

(56) References Cited

U.S. PATENT DOCUMENTS 5,493,382 A 2/1996 Takagaki et al.
5,604,575 A 2/1997 Takagaki et al.
(Continued)

FOREIGN PATENT DOCUMENTS

EP 2 639 645 A2 9/2013
JP 5-40408 A 2/1993
(Continued)

OTHER PUBLICATIONS

Extended European Search Report dated Jan. 3, 2019 in European Patent Application No. 18187890.1 citing documents AA-AB and AO therein, 8 pages.

*Primary Examiner* — Carla J Therrien
(74) *Attorney, Agent, or Firm* — Oblon, McClelland, Maier & Neustadt, L.L.P.

(57) ABSTRACT

An image forming apparatus includes a latent image bearer, an electrostatic latent image forming device, a potential sensor, a toner image forming device, a toner adhesion amount detector, and circuitry. The circuitry controls the electrostatic latent image forming device to create an adjustment pattern on the latent image bearer when the image forming apparatus is not printing, controls the potential sensor to detect an electric potential of the adjustment pattern, controls the electrostatic latent image forming device and the toner image forming device to create a test toner image during a printing period, controls the toner adhesion amount detector to detect a toner adhesion amount of the test toner image, and adjusts at least one image forming condition of the electrostatic latent image forming device and the toner image forming device based on the electric potential of the adjustment pattern and the toner adhesion amount of the test toner image.

13 Claims, 26 Drawing Sheets

(51) Int. Cl.
*G03G 15/08* (2006.01)
*G03G 21/10* (2006.01)

(52) U.S. Cl.
CPC ..... *G03G 15/0865* (2013.01); *G03G 15/0891* (2013.01); *G03G 15/0896* (2013.01); *G03G 15/5037* (2013.01); *G03G 15/5058* (2013.01); *G03G 21/105* (2013.01); *G03G 2215/0116* (2013.01)

(56) References Cited

U.S. PATENT DOCUMENTS

| | | | | |
|---|---|---|---|---|
| 5,765,059 | A | 6/1998 | Kosuge et al. | |
| 6,122,075 | A * | 9/2000 | Yamada | H04N 1/6033 358/406 |
| 9,565,319 | B2 | 2/2017 | Muto et al. | |
| 2002/0141770 | A1* | 10/2002 | Shimura | H04N 1/40025 399/49 |
| 2006/0251435 | A1* | 11/2006 | Mine | G03G 15/0266 399/48 |
| 2013/0230332 | A1 | 9/2013 | Ishii | |
| 2013/0243459 | A1* | 9/2013 | Omori | G03G 15/5058 399/49 |
| 2014/0153941 | A1* | 6/2014 | Miyazaki | G03G 15/0189 399/49 |
| 2014/0270827 | A1* | 9/2014 | Muto | G03G 15/5058 399/49 |
| 2015/0362879 | A1 | 12/2015 | Kaneko et al. | |
| 2016/0112580 | A1* | 4/2016 | Muto | H04N 1/00023 358/1.9 |

FOREIGN PATENT DOCUMENTS

| | | |
|---|---|---|
| JP | 10-133437 | 5/1998 |
| JP | 2002-214852 | 7/2002 |
| JP | 2006-313276 | 11/2006 |
| JP | 2012-181414 | 9/2012 |
| JP | 2015-068833 | 4/2015 |
| JP | 2016-001214 | 1/2016 |
| JP | 2016-206297 | 12/2016 |

* cited by examiner

IMAGE FORMING APPARATUS AND IMAGE FORMING METHOD

CROSS-REFERENCE TO RELATED APPLICATION

This patent application is based on and claims priority pursuant to 35 U.S.C. § 119 to Japanese Patent Application No. 2017-156162, filed on Aug. 10, 2017 in the Japanese Patent Office, the entire disclosure of which is hereby incorporated by reference herein.

BACKGROUND

Technical Field

This disclosure relates to an image forming apparatus and an image forming method.

Description of the Related Art

Some known image forming apparatuses include a control device that forms a toner image for correction on an unused area of a latent image bearer when the image forming apparatus is not printing and corrects an image forming condition based on a toner adhesion amount of the toner image for correction detected by a toner adhesion amount sensor.

SUMMARY

This specification describes an improved image forming apparatus that includes a latent image bearer, an electrostatic latent image forming device to form an electrostatic latent image on the latent image bearer, a potential sensor to detect an electric potential on the latent image bearer, a toner image forming device to form a toner image based on the electrostatic latent image, a toner adhesion amount detector to detect a toner adhesion amount of the toner image, and circuitry. The circuitry controls the electrostatic latent image forming device to create an adjustment pattern on the latent image bearer when the image forming apparatus is not printing, controls the potential sensor to detect an electric potential of the adjustment pattern, controls the electrostatic latent image forming device and the toner image forming device to create a test toner image during printing, controls the toner adhesion amount detector to detect a toner adhesion amount of the test toner image, and adjusts at least one image forming condition of the electrostatic latent image forming device and the toner image forming device based on the detected electric potential of the adjustment pattern and the detected toner adhesion amount of the test toner image.

This specification further describes an improved image forming method that includes creating an adjustment pattern on a latent image bearer when the image forming apparatus is not printing, detecting an electric potential of the adjustment pattern, creating a test toner image during printing, detecting a toner adhesion amount of the test toner image, and adjusting at least one image forming condition of an electrostatic latent image forming device and a toner image forming device based on the detected electric potential of the adjustment pattern and the detected toner adhesion amount of the test toner image.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
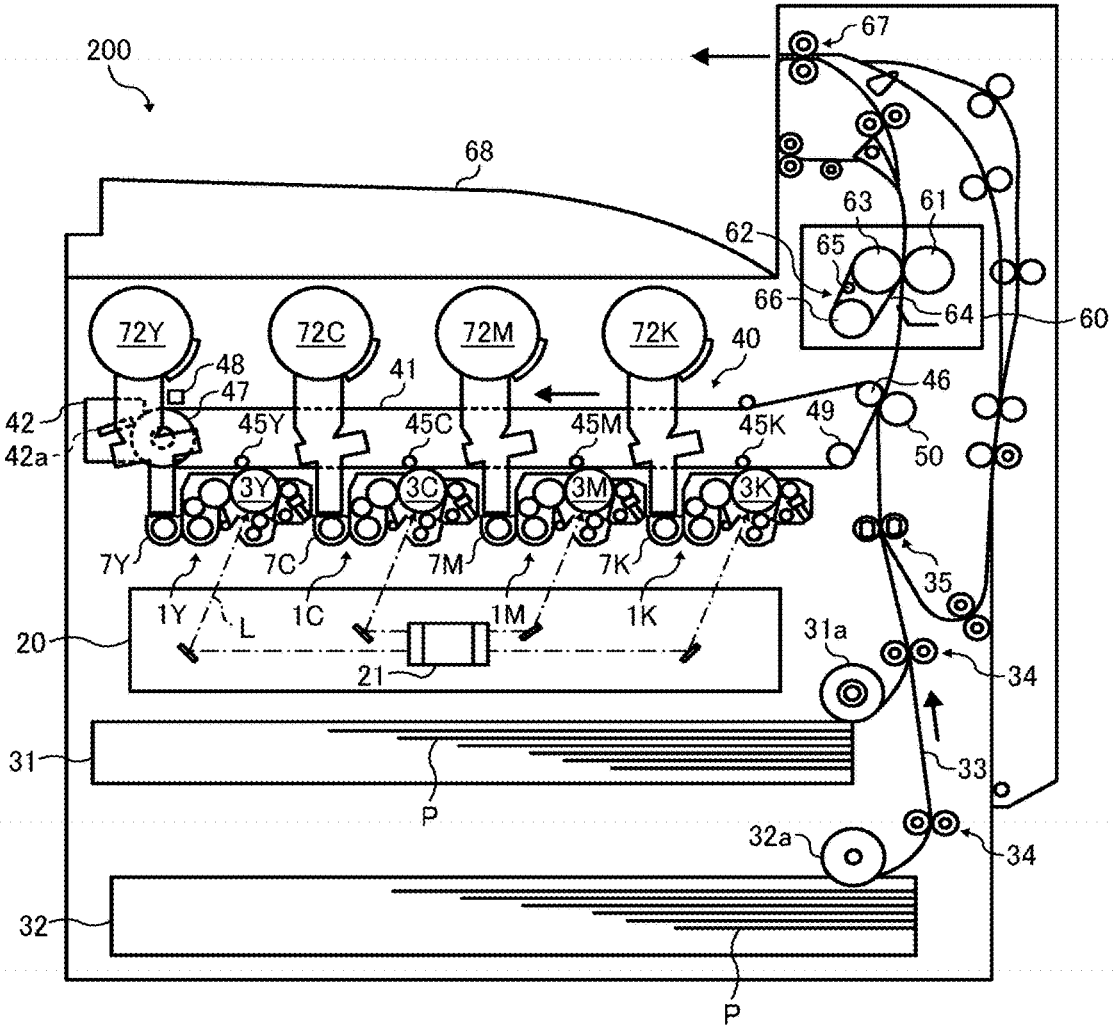
FIG. 1 is a schematic diagram illustrating a printer according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

An electrophotographic printer is described below as an image forming apparatus according to one embodiment of the present disclosure.

First, a description is given of a basic configuration of the printer according to the present embodiment.

FIG. 1 is a schematic diagram illustrating the printer 200 according to the present embodiment.

The printer 200 includes four image forming units 1Y, 1C, 1M, and 1K for forming yellow, cyan, magenta, and black toner images. The image forming units 1Y, 1C, 1M, and 1K have the same configuration except for containing different color toners, i.e., yellow toner, cyan toner, magenta toner, and black toner, respectively.

Figure 2:
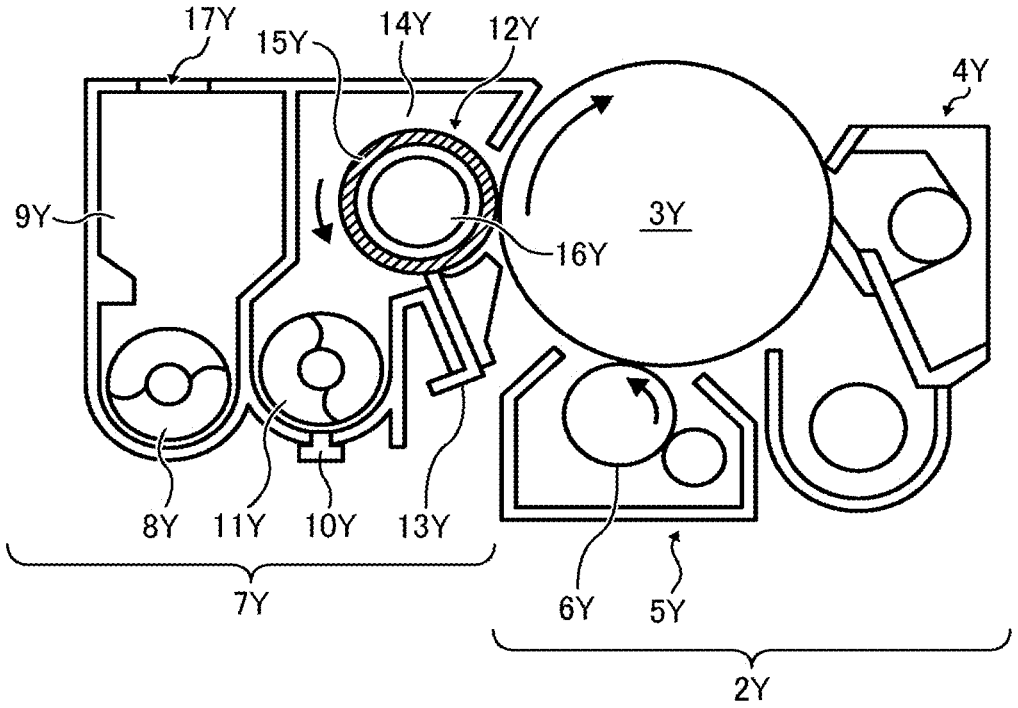
FIG. 2 is a schematic diagram illustrating a configuration of an image forming unit to create a yellow toner image in the printer.

In the image forming unit 1Y, after a charger 5Y illustrated in FIG. 2 uniformly charges a surface of a photoconductor 3Y, a laser beam irradiated from a writing unit 20 scans the surface of the photoconductor 3Y to form an electrostatic latent image. A developing unit 7Y develops the electrostatic latent image formed on the surface of the photoconductor 3Y with yellow toner to form a yellow toner image. The yellow toner image formed on the surface of the photoconductor 3Y is primarily transferred onto an intermediate transfer belt 41. A drum cleaning device 4Y removes toner remaining on the surface of the photoconductor 3Y after the primary-transfer process. Further, a discharger electrically discharges the cleaned surface of the photoconductor 3Y, and thus the photoconductor 3Y is initialized in preparation for subsequent image formation.

In other image forming units 1C, 1M, and 1K as well, toner images are formed on the respective photoconductors 3C, 3M, and 3K and primarily transferred onto the intermediate transfer belt 41.

As illustrated in FIG. 1, the writing unit 20, serving as a latent image forming unit, is disposed beneath the image forming units 1Y, 1C, 1M, and 1K in FIG. 1. The writing unit 20 emits laser light L based on image information to the photoconductors 3Y, 3C, 3M, and 3K in the respective image forming units 1Y, 1C, 1M, and 1K. Thus, electrostatic latent images for yellow, cyan, magenta, and black are formed on the respective photoconductors 3. In the writing unit 20, the laser light L is emitted from a light source, deflected by a polygon mirror 21 that is rotary-driven by a motor, and directed to the photoconductors 3Y, 3C, 3M, and 3K through multiple optical lenses and mirrors. Instead of such a configuration, an LED array may be used.

Below the writing unit 20, a first sheet tray 31 and a second sheet tray 32 are disposed overlapping with each other in the vertical direction. Each of the first and second trays 31 and 32 accommodates recording media P arranged in a stack. A first feed roller 31*a* contacts an uppermost one of the recording media P stacked in the first tray 31. Similarly, a second feed roller 32*a* contacts an uppermost one of the recording media P stacked in the second tray 32. When the first feed roller 31*a* is rotated counterclockwise in the drawing by a driving unit, the top sheet P in the first tray 31 is fed to a sheet feeding path 33 extending vertically on the right in the drawing. When the second feed roller 32*a* is rotated counterclockwise in the drawing by the driving unit, the top sheet P in the second tray 32 is fed to the sheet feeding path 33. Pairs of conveyance rollers 34 are disposed along the sheet feeding path 33 to sandwich the sheet P thus fed to the feeding path 33 between their respective rollers to convey the sheet P along the feeding path 33 upward in FIG. 1. A pair of registration rollers 35 is disposed at the downstream end of the feeding path 33 in the direction in which the sheet P is conveyed (hereinafter "sheet conveyance direction"). The pair of registration rollers 35 stops rotating immediately after the sheet P sent from the pairs of conveyance roller 34 is sandwiched therebetween and then forwards the sheet P to a secondary transfer nip timed to coincide with image formation.

A transfer unit 40 is disposed above the image forming units 1Y, 1C, 1M, and 1K. The transfer unit 40 rotates the intermediate transfer belt 41 counterclockwise in FIG. 1 while stretching the intermediate transfer belt 41. The transfer unit 40 includes a belt cleaning unit 42 and first and second brackets 43 and 44 in addition to the intermediate transfer belt 41. The transfer unit 40 further includes four primary transfer rollers 45Y, 45C, 45M, and 45K, a secondary-transfer backup roller 46, a driving roller 47, an optical sensor 48, and a tension roller 49, around which the intermediate transfer belt 41 is stretched. The intermediate transfer belt 41 is rotated counterclockwise in FIG. 1 as the driving roller 47 rotates. The four primary transfer rollers 45Y, 45C, 45M, and 45K sandwiches the intermediate transfer belt 41 together with the photoconductors 3Y, 3C, 3M, and 3K and forms contact areas called primary transfer nips between the intermediate transfer belt 41 and the photoconductors 3Y, 3C, 3M, and 3K, respectively. Each primary transfer roller 45 applies a transfer bias whose polarity is opposite of the toner (for example, positive) to inside the loop of the intermediate transfer belt 41. The optical sensor 48 is disposed opposite to a portion of the intermediate transfer belt 41 entrained about the driving roller 47. While the rotating intermediate transfer belt 41 sequentially passes through the four primary transfer nips, the yellow, magenta, cyan, and black toner images are superimposed one another on the outer circumferential face of the intermediate transfer belt 41. Thus, a superimposed multicolor (four colors in the present embodiment) toner image is formed on the intermediate transfer belt 41.

The secondary-transfer backup roller 46 sandwiches the intermediate transfer belt 41 together with the secondary transfer roller 50 disposed on the outer side of the loop thereof, thus forming a secondary transfer nip therebetween. The registration rollers 35 forward the sheet P clamped therebetween to the secondary transfer nip, time to coincide with the four-color image on the intermediate transfer belt 41. In the secondary transfer nip, due to the effects of the secondary-transfer electrical field generated between the secondary transfer roller 50 and the secondary-transfer backup roller 46 and nip pressure, the four-color toner image is transferred secondarily from the intermediate transfer belt 41 onto the sheet P at a time. The four-color toner image thus transferred forms a full-color toner image together with the white color of the sheet P.

After the intermediate transfer belt 41 passes through the secondary transfer nip, residual toner not having been transferred onto the sheet P remains on the intermediate transfer belt 41. The belt cleaning unit 42 removes the residual toner. The belt cleaning unit 42 removes toner with a cleaning blade 42*a* that contacts the front surface (outer circumferential surface) of the intermediate transfer belt 41.

The transfer unit 40 is configured to be swingable at a predetermined angle in accordance with on/off driving operation of a solenoid. In monochrome image formation, swing of the transfer unit 40 disengages the intermediate transfer belt 41 from the photoconductors 3Y, 3M, and 3C for yellow, magenta, and cyan. Then, monochrome images are formed by driving only the image forming unit 1K out of the four image forming units 1Y, 1C, 1M, and 1K. This operation can eliminate wear of the image forming units 1Y, 1M, and 1Y resulting from unnecessary driving thereof during monochrome image formation.

Above the secondary transfer nip in FIG. 1, a fixing device 60 to fix toner images on the sheet P is provided. The fixing device 60 includes a pressure heating roller 61 and a fixing belt unit 62. The pressure heating roller 61 contains a heat source, such as a halogen lamp, inside. The fixing belt unit 62 includes a fixing belt 64, a heating roller 63 including a heat source such as a halogen lamp, a tension roller 65, a driving roller 66, and a temperature sensor. The fixing belt 64, which is an endless belt, is stretched around the heating roller 63, the tension roller 65, and the driving roller 66 and rotated counterclockwise in FIG. 1. While rotating, the fixing belt 64 is heated by the heating roller 63 from the back side (inner face). The pressure heating roller 61 rotates clockwise in FIG. 1 and contacts, from the front side (outer face), a portion of the fixing belt 64 stretched around the heating roller 63. With this configuration, a fixing nip is formed between the pressure heating roller 61 and the fixing belt 64 pressing against each other.

Outside the loop of the fixing belt 64, a temperature sensor is disposed facing the outer face of the fixing belt 64 across a predetermined clearance to detect the surface temperature of the fixing belt 64 immediately before entering the fixing nip. The detection result is transmitted to a fixing power supply circuit. The fixing power supply circuit turns on and off power supply to the heat source inside the heating roller 63 and the heat source inside the pressure heating roller 61 according to the detection results generated by the temperature sensor. As a result, the surface temperature of the fixing belt 64 is maintained at about 140° C. After passing through the secondary-transfer nip, the sheet P leaves the intermediate transfer belt 41 and enters the fixing device 60. While the sheet P is nipped in the fixing nip of the fixing device 60 and transported upward in FIG. 1, the fixing belt 64 and the pressure heating roller 61 heat and press the sheet P, thereby fixing the toner image thereon.

Then, the sheet P having the fixed toner image is conveyed to a pair of ejection rollers 67 and ejected outside the printer. The pair of ejection rollers 67 sandwiches the sheet P between its rollers and ejects the sheet P onto an ejection tray 68 on top of a printer body. Thus, the plurality of sheets P is stacked one atop another on the ejection tray 68.

Toner bottles 72Y, 72C, 72M, and 72K for containing yellow, cyan, magenta, and black toners, respectively, are provided above the transfer unit 40. A toner supply device 70 supplies the respective color toners in the toner bottles 72Y, 72C, 72M, and 72K to the developing units 7Y, 7C, 7M, and 7K in the image forming units 1Y, 1C, 1M, and 1K, respectively, as required. The toner bottles 72Y, 72C, 72M, and 72K can be installed in and removed from the printer body separately from the image forming units 1Y, 1C, 1M, and 1K.

FIG. 2 is a schematic diagram illustrating a configuration of the image forming unit 1Y to create a yellow toner image.

The image forming unit 1Y includes a photoconductor unit 2Y and a developing unit 7Y. The photoconductor unit 2Y and the developing unit 7Y can be united into the image forming unit 1Y and installed in and removed from the printer body together at a time. The developing unit 7Y is formed as a modular unit (i.e., a developing unit) that can be separated from the photoconductor unit 2Y when removed from the printer body.

The photoconductor unit 2Y includes a drum-shaped photoconductor 3Y serving as a latent image bearer, a drum cleaning device 4Y, a discharger, a charger 5Y, and a potential sensor 18Y. A charging roller 6Y in the charger 5Y uniformly charges the surface of the photoconductor 3Y that is rotated by a drive device in a clockwise direction in FIG. 2. Specifically, while a power source applies a charging bias to the charging roller 6Y rotating counterclockwise in FIG. 2, the charging roller 6Y is disposed close to or in contact with the photoconductor 3Y, thereby charging the photoconductor 3Y uniformly. It is to be noted that the charging device is not limited thereto. For example, the charging device may include, instead of the charging roller 6Y, a different charging device such as a charging brush disposed close to or in contact with the photoconductor 3Y. Yet alternatively, chargers such as a scorotron charger may be used. The laser beam emitted from the writing unit 20 illustrated in FIG. 1 exposes and scans the surface of the photoconductor 3Y uniformly charged by the charger 5Y, and the surface of the photoconductor 3Y bears the electrostatic latent image for yellow.

As illustrated in FIG. 2, the developing unit 7Y includes a first developer compartment 9Y in which a first conveying screw 8Y serving as a developer conveyance member is provided. The developing unit 7Y further includes a second developer compartment 14Y provided with a toner concentration sensor 10Y to detect toner concentration in developer, a second conveying screw 11Y, a developing roller 12Y serving as a developer bearer, and a doctor blade 13Y serving as a developer regulator. The toner concentration sensor 10Y may be a magnetic permeability sensor. Yellow two-component developer including magnetic carrier and negatively charged yellow toner is contained in the first and second developer compartments 9Y and 14Y that together constitute a circulation channel. Being rotated by a driver, the first conveying screw 12*b* transports the yellow developer inside the first developer compartment 9Y to the front side of the paper on which FIG. 2 is drawn. In the first developer compartment 9Y, a position facing a toner supply inlet 17Y is referred to a supply position. The toner concentration sensor 10Y is fixed on a case of the developing unit 7Y under the first conveying screw 8Y and detect the concentration of toner in the yellow developer passing by a predetermined detection position that is downstream from the supply position in a direction in which the yellow developer is circulated (hereinafter "developer circulating direction"). Yellow developer transported to the downstream end of the first developer compartment 9Y by the first conveying screw 8Y flows through a communicating opening into the second developer compartment 14Y.

Being rotated by the driver, the second conveying screw 11Y inside the second developer compartment 14Y transports the yellow developer to the back side of the paper on which FIG. 2 is drawn. In FIG. 2, the developing roller 12Y is disposed parallel to and above the second conveying screw 11Y that conveys the yellow developer. The developing roller 12Y includes a developing sleeve 15Y that rotates counterclockwise in FIG. 2 and a stationary magnet roller 16Y provided inside the developing sleeve 15Y. The developing sleeve 15Y can be a nonmagnetic pipe, for example. A part of developer transported by the second conveying screw 11Y is scooped onto the surface of developing sleeve 15Y due to magnetic force exerted by the magnet roller 16Y. The doctor blade 13Y is disposed across a predetermined gap from the surface of the developing sleeve 15Y and adjusts the film thickness of developer carried on the developing sleeve 15Y, after which developer is transported to a development area facing the photoconductor 3Y. Then, toner adheres to the electrostatic latent image formed on the photoconductor 3Y. Thus, the yellow toner image is formed on the photoconductor 3Y. After yellow toner therein is thus consumed, yellow developer is returned to the second conveying screw 11Y as the developing sleeve 15Y rotates. Yellow developer transported to the downstream end of the second developer compartment 14Y by the second conveying screw 11Y returns through a communicating opening into the first developer compartment 9Y. Thus, yellow developer is circulated inside the developing unit 7Y.

The toner concentration sensor 10Y detects the toner concentration of the developer in the first developer compartment 9Y immediately before entering the second developer compartment 14Y. The toner supply inlet 17Y is disposed at a position in which toner is supplied to the developer immediately after the developer enters the first developer compartment 9Y from the second developer compartment 14Y. That is, in the first developer compartment 9Y, the toner concentration sensor 10Y detects the toner concentration of the developer at a position downstream of the toner supply inlet 17Y.

Figure 3:
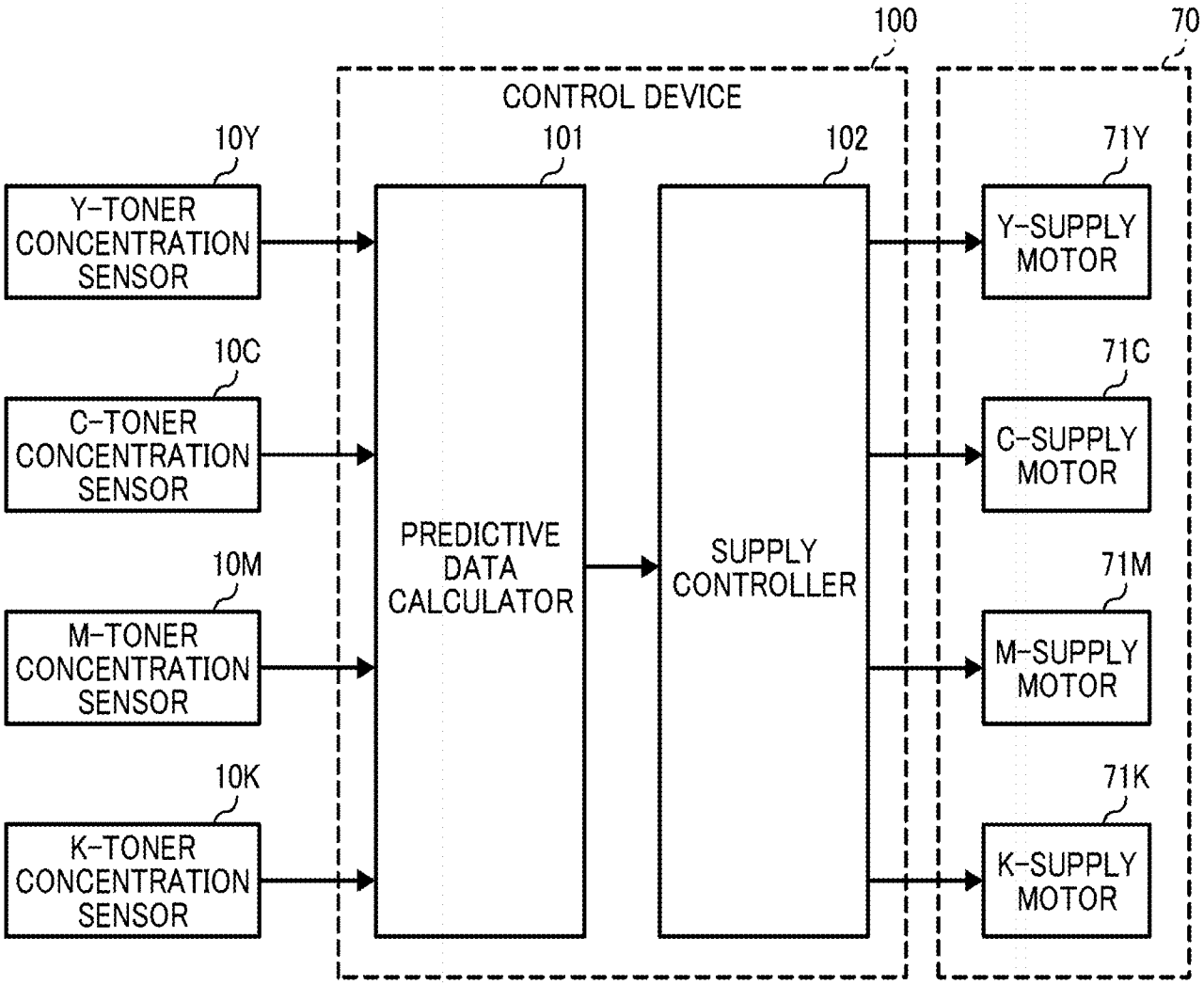
FIG. 3 is a functional block diagram illustrating a toner supply control mechanism in the printer.

FIG. 3 is a functional block diagram illustrating a toner supply control mechanism.

A control device 100 includes a predictive data calculator 101 and a supply controller 102. The supply controller 102 serves as a toner supply controller in the control device 100 to control a drive timing, a drive time, a drive speed, or the like of a toner supply motor for each color 71Y, 71C, 71M, and 71K that drives a toner supply member of the toner supply device 70 to adjust an amount of toner supplied. A known toner supply member can be widely used as long as the toner supply motor 71Y can adjust the amount of toner supplied from the toner supply inlet 17Y illustrated in FIG. 2 to the yellow developer.

A voltage indicating the magnetic permeability detected by the toner concentration sensor 10Y that corresponds to the toner concentration of the yellow developer in the developing unit 7Y for yellow illustrated in FIG. 2 is transmitted to the control device 100 as electrical signals.

The control device 100 includes a central processing unit (CPU) as a computing unit, a random-access memory (RAM) and a read only memory (ROM) as data storage units, and the like, and can execute various arithmetic processing and control programs. In the RAM, the control device 100 stores target values Vtref for the respective colors that are targets of voltages output from the toner concentration sensors 10Y, 10C, 10M, and 10K provided to the developing units 7Y, 7C, 7M, and 7K, respectively.

With respect to the developing unit 7Y for Yellow, the control device 100 compares the value of the output voltage from the toner concentration sensor 10Y with the value Vtref for yellow and controls the yellow toner supply motor 71Y, which is illustrated as Y-supply motor 71Y in FIG. 3, in the toner supply device 70 to supply yellow toner in an amount corresponding to the comparison result. Then, yellow toner is supplied to the first developer compartment 9Y to compensate for the decrease in the concentration of yellow toner consumed in image development. Thus, the concentration of yellow toner in developer contained in the second developer compartment 14Y can be kept in a predetermined or desirable range.

Similar toner supply control is performed in the developing units 7C, 7M, and 7K for other colors which have a cyan toner supply motor illustrated as C-supply motor 71C in FIG. 3, a magenta toner supply motor illustrated as M-supply motor 71M in FIG. 3, and a black toner supply motor illustrated as K-supply motor 71K in FIG. 3, respectively.

The supply controller 102 controls the toner supply motor 71Y in the toner supply device 70 based on the prediction data calculated by the predictive data calculator 101 in the control device 100. Based on the toner concentration detected by the toner concentration sensor 10Y, the predictive data calculator 101 calculates prediction data of the temporal change of the yellow toner concentration of the yellow developer using a calculation program and a table for calculation stored in the ROM. The supply controller 102 in the control device 100 controls the Y-supply motor 71Y based on the prediction data calculated by the predictive data calculator 101 to compensate for any decrease in toner concentration.

Figure 4:
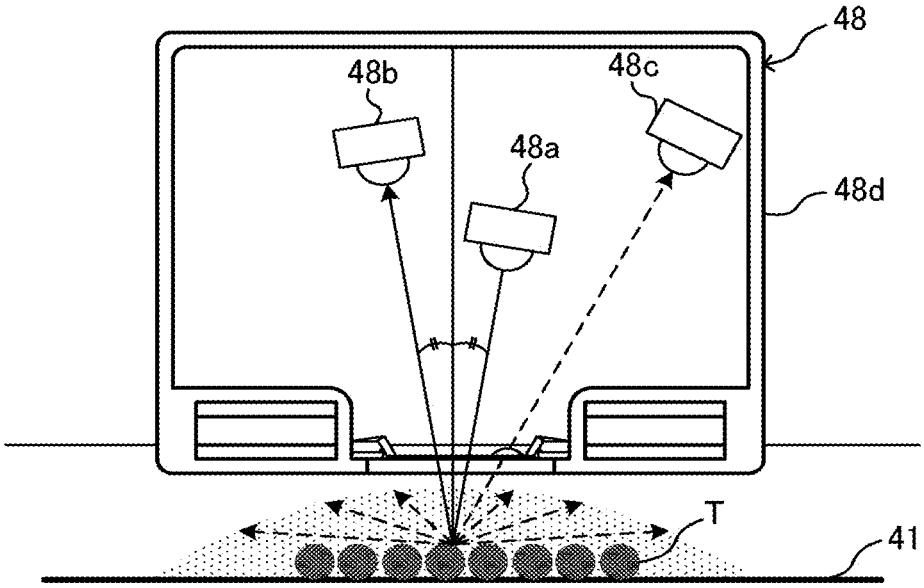
FIG. 4 is a schematic diagram illustrating an optical sensor in the printer.

FIG. 4 is a schematic diagram illustrating an optical sensor 48 in FIG. 1.

The optical sensor 48 includes an LED 48 a as a light emitting device mounted on a mounting board, a specular reflection light receiving element 48*b* as a specular reflected light receiving device, a diffuse reflected light receiving element 48*c* as a diffusely reflected light receiving device, and a case 48*d* to accommodate the light emitting device and the light receiving devices to prevent incidence of ambient light. In the present embodiment, a case 48*d* molded with a black resin is used. The LED 48*a* is arranged between the specular reflection light receiving element 48*b* and the diffuse reflection light receiving element 48*c*. A laser diode may be also used as an example of the light emitting device. A phototransistor, a photodiode or the like is used as the light receiving means. The LED 48*a*, the specular reflection light receiving element 48*b*, and the diffuse reflection light receiving element 48*c* are mounted so as to be oriented in a direction parallel to the surface of a mounting substrate. The specular reflection light receiving element 48*b* receives regular reflection light irradiated from the LED 48*a* and reflected by the intermediate transfer belt 41. The diffuse reflected light receiving element 48*c* receives diffuse reflected light.

Figure 5A:
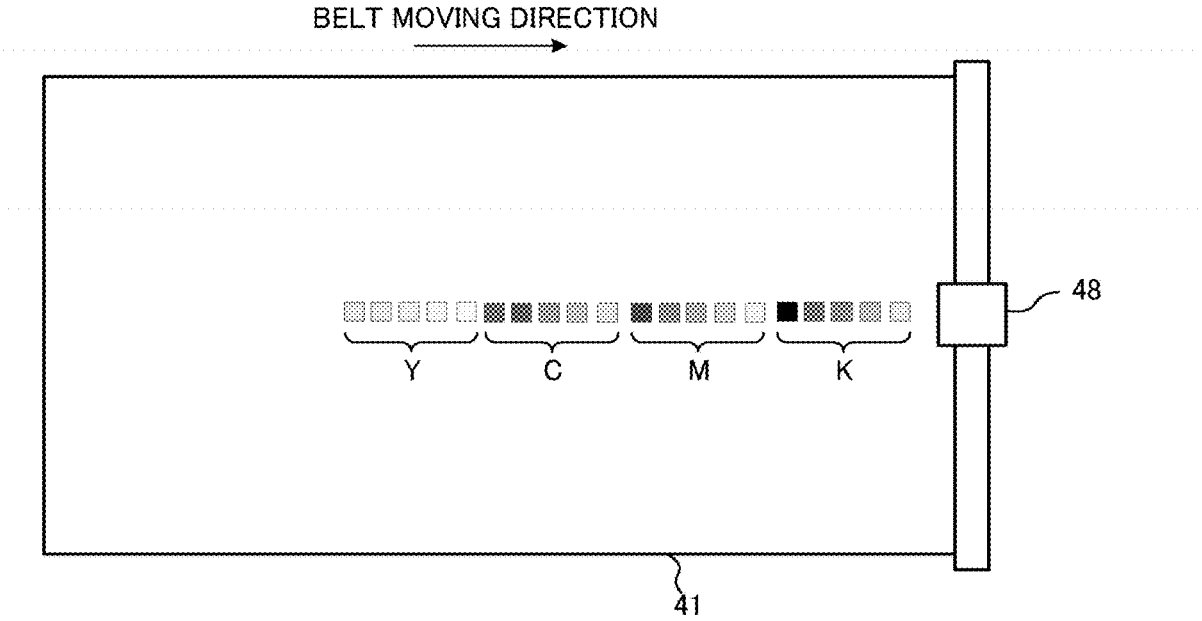
FIG. 5A is an explanatory diagram illustrating an example in which one optical sensor detects toner adhesion amount of each color gradation pattern formed in a line along a direction of movement of an intermediate transfer belt that is a sub-scanning direction.

As illustrated in FIG. 5A, the optical sensor 48 disposed near the center position in a main scanning direction which is a direction perpendicular to the direction of movement of the intermediate transfer belt 41. As described later, during process control, a toner pattern, which is a plurality of image density detection patches having different image densities, is formed for each color. Hereinafter, the toner pattern is referred to as a gradation pattern. A layout in which the gradation pattern for each color is formed in a line along a sub-scanning direction, that is, the direction of movement of the intermediate transfer belt 41 enables one optical sensor 48 to detect toner adhesion amounts of gradation patterns for all colors. In this case, it is preferable that the gradation pattern of each color is formed near the center position in the main scanning direction. This is because the toner adhesion amount detected at the center position is less influenced by an image density deviation within an image formation area width in the main scanning direction.

Figure 5B:
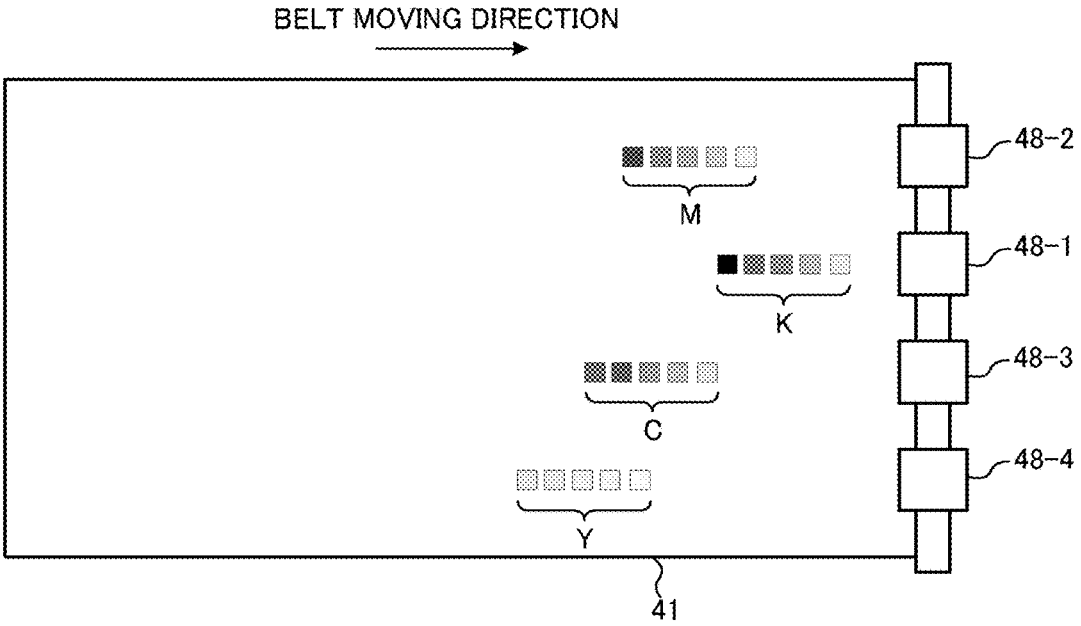
FIG. 5B is an explanatory diagram illustrating an example in which optical sensors disposed at different main scanning positions individually detect each color gradation pattern formed at different positions in the main scanning direction.

FIG. 5 (*a*) illustrates an example in which the toner adhesion amounts of all color gradation patterns are detected by one optical sensor 48, but as illustrated in FIG. 5(*b*), four optical sensors 48-1 to 48-4 may be arranged at mutually different positions in the main scanning direction. The gradation pattern for each color is formed to pass through the target areas of the optical sensors 48-1 to 48-4. Using a plurality of optical sensors in this way enables to shorten processing time for the toner adhesion amount detection of all the color gradation patterns by the optical sensors 48-1 to 48-4. Although the present embodiment employs the four optical sensors 48-1 to 48-4 illustrated in FIG. 5B, alternatively it may employ the one optical sensor 48 illustrated in FIG. 5A.

Figure 6:
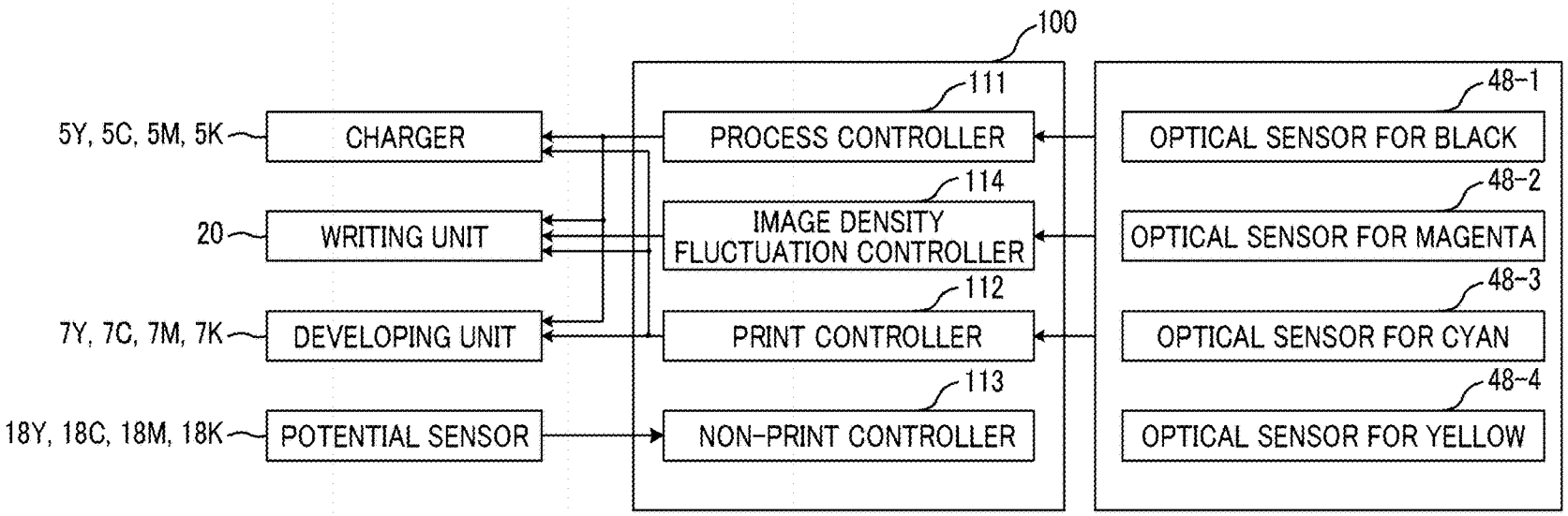
FIG. 6 is a block diagram illustrating a control system for image density control in the printer of FIG. 1.

FIG. 6 is a block diagram illustrating a control system to control an image density in the present embodiment.

The control device 100 includes a process controller 111 to control the process control that is the image density adjustment control during a non-printing period when the image forming apparatus is not printing (hereinafter called non-printing period), a print controller 112 to control an image density adjustment control during printing, a non-print controller 113 that controls a non-printing process to acquire electric potential data, and an image density fluctuation controller 114 to control the image density fluctuation control. The function of the control device 100 is implemented by, for example, the CPU, the ROM, the RAM, and the like.

In the present embodiment, after the process controller 111 performs the process control during the non-printing period, the non-print controller 113 performs the non-printing process and acquires electric potential data that is used in the image density adjustment control during printing. During the image formation process, that is, during an operation of forming a desired image on a medium such as the sheet P, the image formation is performed in a state in which the image forming condition is adjusted to the setting value adjusted by the process control, and the image density fluctuation controller 114 performs the image density fluctuation control to decrease the image density fluctuation during the image formation. Additionally, during printing, using the electric potential data which the non-print controller 113 acquires by the non-printing process during the non-printing period, the print controller 112 performs the image density adjustment control during printing to adjust the setting value of the image forming condition.

Next, the process control, which is an image density adjustment control performed by the process controller 111 in the present embodiment, is described.

In broad outline, the process controller 111 of the image forming apparatus according to the present disclosure performs the process control that is the image density adjustment control to optimize the image density in each color at a predetermined timing such as at the time of turning on the power or after forming a predetermined number of images. In the process control, the process controller 111 forms the gradation pattern composed of toner patches having different image densities on the intermediate transfer belt 41 by switching the charging bias and the developing bias and controls the optical sensor 48 serving as a toner adhesion amount detector disposed opposite to a belt portion wound around the driving roller 47 of the intermediate transfer belt 41 to detect toner adhesion amounts of the formed patches in the gradation pattern. Specifically, the output voltage of each patch in the gradation pattern detected by the optical sensor 48 (see FIG. 1) is converted into the toner adhesion amount of each patch in the gradation pattern. The process controller 111 uses the detection result to calculate the development γ representing development capability and the development threshold voltage Vk and, based on the calculated value, adjusts the image forming conditions such as the charging bias, the developing bias, the exposure intensity, and a toner concentration control target value. The optical sensor 48 may detect the toner adhesion amount on the photoconductor 3 instead of detecting the toner adhesion amount on the intermediate transfer belt 41.

In the present embodiment, a "charged potential" means a surface potential of the photoconductor 3 uniformly charged by the charger 5, an "exposure potential" means a surface potential of the photoconductor 3 that is exposed by the writing unit 20, that is, a potential of an exposure portion, a "development potential" means a surface potential of the developing roller 12, the "developing potential" means a difference between the development potential and the exposure potential, and a "background potential" means a difference between the charged potential and the development potential. Generally, the toner has a charge the size of which varies depending on the state of the developer and usage environment. The toner carried on the developing roller 12 of the developing unit 7 moves to the exposure portion on the surface of the photoconductor 3 by the developing potential. Therefore, the toner adhesion amount on the exposure portion of the photoconductor 3 varies depending on the charge of the toner and the developing potential.

Figure 7:
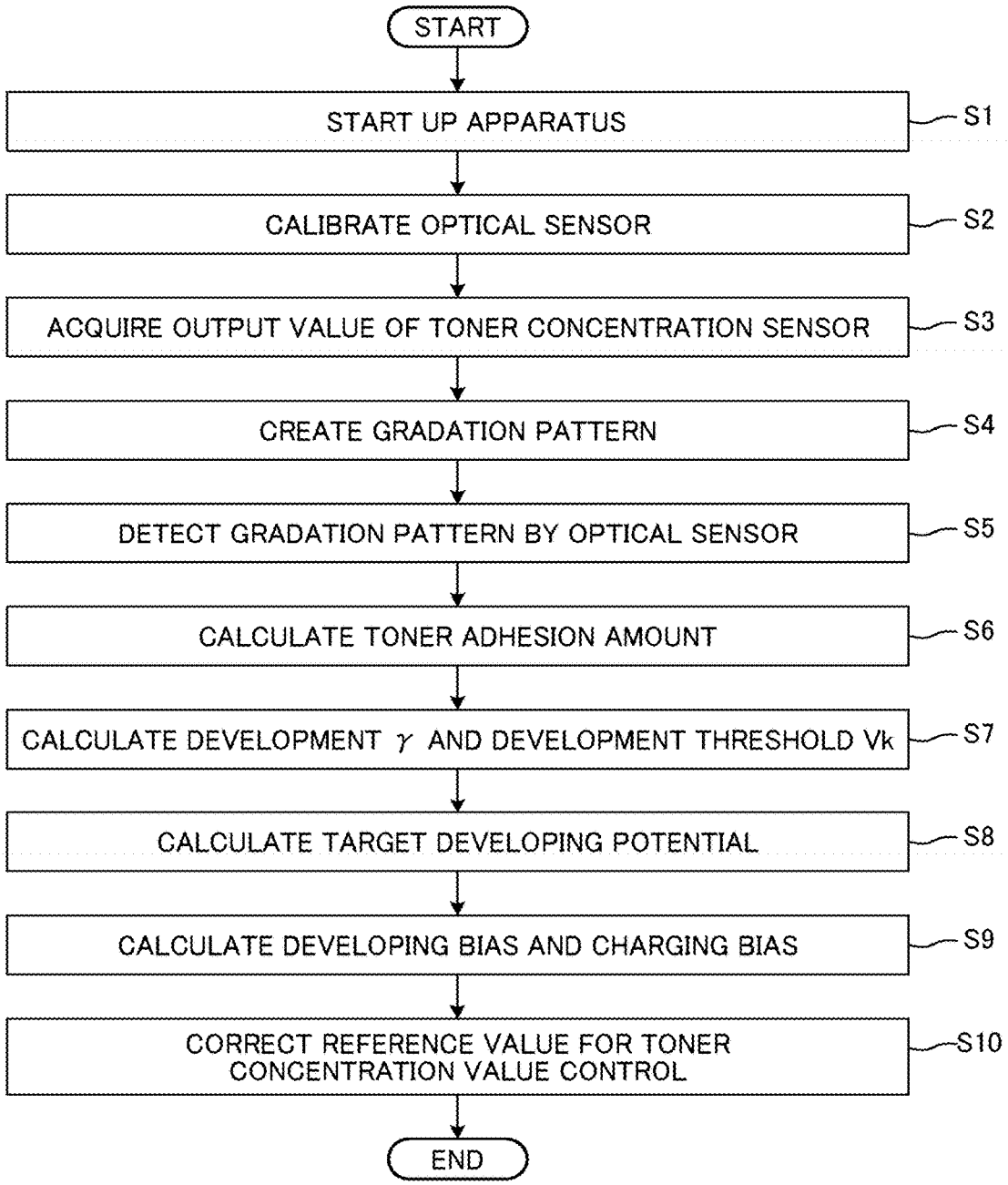
FIG. 7 is a flowchart illustrating process control in the printer.

FIG. 7 is a flowchart illustrating the basic operation of the process control controlled by the process controller 111 illustrated in FIG. 6. The process controller 111 performs this process control to stabilize the image density by correcting the charging bias Vc, the exposure intensity LDP, the developing bias Vb, and the toner concentration control target value Vtref. At predetermined operation timings such as turning on the power supply or after printing a predetermined number of sheets, the process controller 111 turns on various motors and biases of various devices and performs preparations for executing the process control in step S1. Then, if necessary, the process controller 111 performs a sensor calibration process for adjusting the drive current of the LEDs 48*a* of the optical sensors 48-1 to 48-4 in step S2. In this sensor calibration process, the process controller 111 controls the LEDs 48*a* to irradiate the surface of the intermediate transfer belt 41 with light, controls the specular reflection light receiving element 48*b* to detect the regular reflection light, and adjusts a driving current of the LED 48*a* to set an output voltage of the detected specular reflection light to 4 [V]. This sensor calibration process is referred to as "Vsg adjustment". However, since the Vsg adjustment is time-consuming, the process controller 111 may simply control the LEDs 48*a* to irradiate the surface of the intermediate transfer belt 41 with light using the drive current value at the previous Vsg adjustment for a predetermined time, detect output voltages of the regular reflection light, and calculate an average value Vsg_ave. If the average value Vsg_ave is within the predetermined range, the process controller 111 may use the drive current value at the previous Vsg adjustment.

Subsequently, the process controller 111 acquires the output value Vt of the toner concentration sensor 10 in the developing unit 7 in step S3.

The output value Vt of the toner concentration sensor 10 corresponds to toner concentration of the developer at that time.

Subsequently, the process controller 111 creates gradation patterns whose positions corresponds to the positions of the optical sensors 48-1 to 48-4 in the main scanning direction in step S4.

An example of a gradation pattern has patches each having a main scanning direction length of 10 mm, a sub scanning direction length of 14.4 mm, and a patch interval of 5.6 mm. Preferably, the number of patches of the gradation pattern created in each color is set such that a length of the gradation pattern becomes within the distance between the primary transfer positions of the neighboring respective color image forming units 1, that is, the distance between the centers of the neighboring photoconductors 3 of the respective colors (hereinafter referred to as "inter-unit distance").

As a specific example of the number of patches in the above gradation pattern, when the inter-unit distance is 100 mm, the maximum number of patches of each color that can fit in the inter-unit distance becomes five because (inter-unit distance: 100 mm)/(length of each patch in the sub-scanning direction: 14.4 mm+patch interval: 5.6 mm)=5. In creating the gradation pattern, the process controller 111 sets the exposure intensity of the writing unit 20 at the maximum value that sufficiently attenuates the surface potential of the photoconductor 3 and changes the developing bias Vb (=the development potential) and the charging bias Vc (=the charged potential) in each patch, thereby creating a gradation pattern composed of five patches with different toner adhesion amounts.

Subsequently, the optical sensors 48-1 to 48-4 detect the toner adhesion amount of the created gradation patterns in step S5.

The created color gradation patterns are primarily transferred onto the intermediate transfer belt 41 so that the color gradation patterns are formed on different positions in the main scanning direction on the intermediate transfer belt 41. Each of the optical sensors 48-1 to 48-4 detects the toner adhesion amount of each of the color gradation patterns. In the present embodiment, the toner adhesion amount of the black gradation pattern is detected by only output value of the specular reflection light receiving element 48*b*, that is, by only the specular reflection light amount. The toner adhesion amounts of the gradation patterns of cyan, magenta, and yellow are detected by both the output value of the specular reflection light receiving element 48*b* and the output value of the diffuse reflection light receiving element 48*c*, that is, by both the specular reflection light amount and the diffuse reflection light amount.

To take a specific example, the process controller 111 detects the toner adhesion amount of the patch in the gradation patterns at a sampling interval of 4 ms. The process controller 111 specifies output values in each patch from output values of the optical sensors 48-1 to 48-4, samples a predetermined number of output values, averages the output values corresponding to each patch by the sampled predetermined number, and determines the average as a toner adhesion amount detection value Vsp of each patch. Preferably, the sampling points of each patch are near the central portion of the patch, especially, near the central portion of the patch in the sub-scanning direction. This is because the increase in the toner adhesion amount due to the edge effect at the edge portion of the patch leads the average value including the sampling point of the edge portion higher than the value corresponding to the actual toner adhesion amount of the patch.

Subsequently, the process controller 111 converts the toner adhesion amount detection value Vsp of the optical sensors 48-1 to 48-4 into the toner adhesion amount in step S6.

In this conversion process, the toner adhesion amount detection value Vsp for each patch is converted into the toner adhesion amount by using a previously prepared toner adhesion amount conversion table.

Subsequently, in step S7, the process controller 111 calculates the development γ and the development threshold voltage Vk based on the relation between the developing potential of each patch when the gradation pattern is created and the toner adhesion amount of each patch obtained in step S6.

Figure 8:
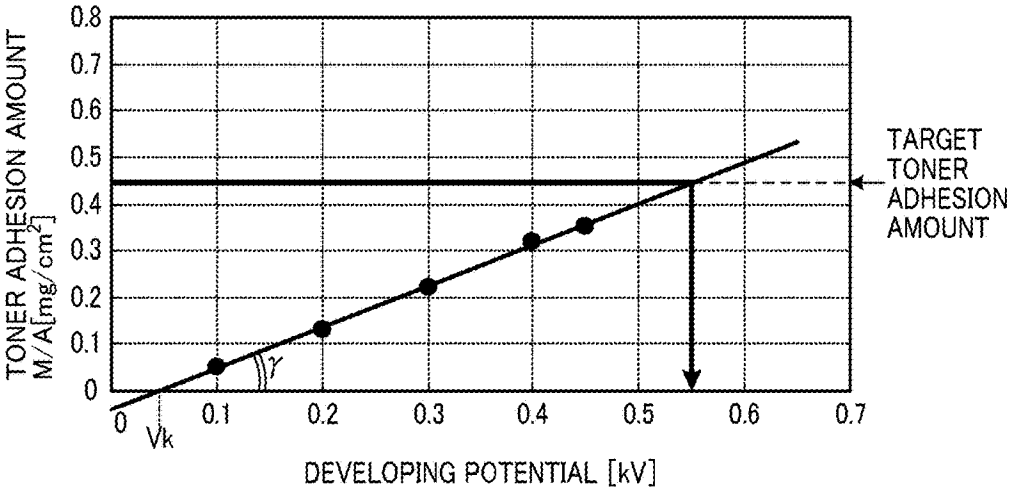
FIG. 8 is a graph illustrating an example of a relation between a developing potential and a toner adhesion amount in the printer.

As illustrated in FIG. 8, the relation between the developing potential and the toner adhesion amount is approximated to a linear equation in a graph in which the developing potential is the horizontal axis and the toner adhesion amount is the vertical axis. For this approximation, for example, the least squares method or the like may be used. The inclination of the primary linear equation approximated in this way is called "development γ", and the intercept on the horizontal axis is called "development threshold voltage Vk". The development γ and the development threshold voltage Vk obtained in this way are parameters for specifying the primary linear equation and are index values indicating the developing ability at that time.

Subsequently, the process controller 111 calculates a target developing potential for obtaining the target toner adhesion amount from the primary linear equation corresponding to the relation between the developing potential and the toner adhesion amount in step S8. With reference to the graph in FIG. 8, the process controller 111 specifies the target developing potential in the horizontal axis, which corresponds to the target toner adhesion amount in the vertical axis, from the primary linear equation. The target toner adhesion amount is a predetermined value, for example, a value necessary for obtaining the maximum image density, that is, a solid image density. The target toner adhesion amount varies depending on the coloring degree of the toner pigment, the toner particle diameter, and the like, but is generally about 0.4 to 0.6 mg/cm$^2$.

Subsequently, the process controller 111 determines the developing bias Vb from the target developing potential determined in this manner in step S9. The relation between the developing bias Vb and the developing potential satisfies the relational expression of the developing bias Vb [−V]=the developing potential [−V]+the exposure potential VL [−V]. As the exposure potential VL in the above equation, the process controller 111 may use a predetermined target value of the exposure potential VL.

Further, the process controller 111 calculates the charging bias Vc by using the relational expression of the charging bias Vc [−V]=the developing bias Vb [−V]+the background potential [−V] based on the developing bias Vb calculated as above and the background potential in step S9. The background potential is set in advance so that carriers in the developer do not adhere to the photoconductor 3.

Subsequently, if necessary, the process controller 111 corrects the toner concentration control target value (Vtref) in step S10.

Specifically, the process controller 111 corrects the toner concentration control target value (Vtref) based on the development γ obtained in step S7 and the output value Vt of the toner concentration sensor 10 acquired in step S3. The process controller 111 calculates a deviation Δγ of γ, that is, Δγ=Δγ=(current development γ)−(target development γ) to confirm the deviation of the development γ from the target development γ predetermined in advance to the current development γ calculated in step S7. The deviation Δγ of the development γ outside the target range causes the development bias Vb or the charging bias Vc which are calculated from the current development γ obtained in step S7 to exceed allowable setting range or causes an abnormal image even when the developing bias Vb and the charging bias Vc are set within the allowable setting range. Correcting the toner concentration control target value Vtref changes the toner concentration in the developer and the development γ. Therefore, when the deviation Δγ is out of the target range, the process controller 111 corrects the toner concentration control target value (Vtref) so that the deviation Δγ becomes small.

For example, in correction of the toner concentration control target value Vtref, when the deviation Δγ exceeds the target range to the plus side, that is, when the current development γ is greater than the target development γ, the process controller 111 sets the toner concentration control target value Vtref to a value obtained by subtracting a predetermined value from the output value Vt of the toner concentration sensor 10 obtained in step S3. In other words, the process controller 111 corrects the toner concentration control target value Vtref so that the toner concentration in the developer becomes lower than that at the present time.

On the other hand, when the deviation Δγ exceeds the target range to the minus side, that is, when the current development γ is smaller than the target development γ, the process controller 111 sets the toner concentration control target value Vtref to a value obtained by adding the predetermined value to the output value Vt of the toner concentration sensor 10 obtained in step S3. In other words, the process controller 111 corrects the toner concentration control target value Vtref so that the toner concentration in the developer becomes higher than that at the present time. If the deviation Δγ is within the target range, the process controller 111 does not correct the toner concentration control target value Vtref.

When the output value Vt of the toner concentration sensor 10 acquired in step S3 differs substantially greatly from the current toner concentration control target value Vtref, it is preferable not to correct the toner concentration control target value Vtref. In this case, correction of the toner concentration control target value Vtref may degrade the image quality instead.

Next, the operation of the image density fluctuation control executed by the image density fluctuation controller 114 illustrated in FIG. 6 is described.

In broad outline, the image density fluctuation controller 114 of the present embodiment creates a pattern for detecting the image density fluctuation, controls the optical sensors 48-1 to 48-4 to detect the toner adhesion amount of the image density fluctuation detection pattern (hereinafter referred to as "fluctuation detection pattern"), specifies the image density fluctuation in the sub scanning direction from the detection result, and executes the image density fluctuation control according to the correction control pattern for controlling the image forming condition to decrease the image density fluctuation. The image density fluctuation controller 114 performs forming and processing the correction control pattern in this image density fluctuation control during the non-printing period and before or after the above-described process control, but may perform forming and processing the correction control pattern at another timing different from the above-described process control.

The image density fluctuation assumed here mainly consists of image density fluctuation caused by the rotation period of the photoconductor 3 and image density fluctuation caused by the rotation period of the developing roller 12. The image density fluctuation caused by the rotation period of the photoconductor 3 mainly occurs due to the fluctuation of the developing gap caused by the rotational shake due to the eccentricity or the like of the photoconductor 3 and sensitivity unevenness in the sub scanning direction of the photosensitive layer of the photoconductor 3. The image density fluctuation caused by the rotation period of the developing roller 12 mainly occurs due to the fluctuation of the developing gap caused by the rotational shake due to the eccentricity of the developing roller 12. The image density fluctuation controller 114 may execute control to reduce image density fluctuation caused by the rotation period of another rotating body such as the charging roller 6 and non-periodic image density fluctuation.

Figure 9:
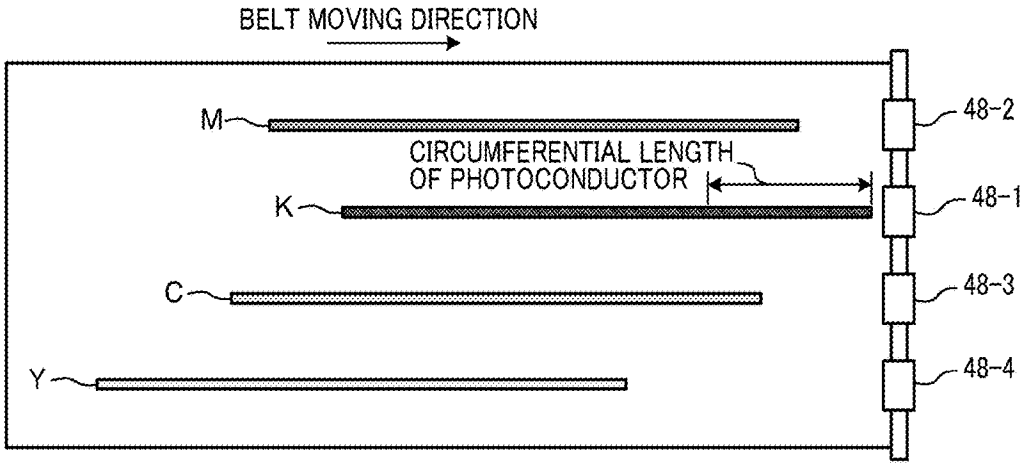
FIG. 9 is an explanatory diagram illustrating an example of a layout of fluctuation detection patterns of respective colors in the printer.

FIG. 9 is an explanatory diagram illustrating fluctuation detection patterns for respective colors to detect image density fluctuation in the present embodiment.

As illustrated in FIG. 9, the image density fluctuation controller 114 forms the fluctuation detection patterns for respective colors at positions on the intermediate transfer belt 41 corresponding to the positions of four optical sensors 48-1 to 48-4 in the main scanning direction, respectively, and controls each of the optical sensors 48-1 to 48-4 to detect a toner adhesion amount of each fluctuation detection pattern for respective colors. The image density fluctuation controller 114 sets length in the sub-scanning direction of the fluctuation detection pattern for respective colors to a length equal to or greater than the circumferential length of the photoconductor 3 to detect image density fluctuation occurring in the rotation period of the photoconductor 3. In the present embodiment, the length is set to about three times the circumferential length of the photoconductor 3. Since the circumferential length of the developing roller 12 is shorter than the circumferential length of the photoconductor 3 as illustrated in FIG. 2, the fluctuation detection pattern set to have a length equal to or greater than the circumferential length of the photoconductor 3 may be used together to detect the image density fluctuation occurring in the rotation period of the developing roller 12.

In the present embodiment, an image density of the fluctuation detection pattern is set to 70%. Since the fluctuation detection pattern having the image density in the range of 15% to 100% has high accuracy of the fluctuation detection, one image density within this range may be selected as the image density of the fluctuation detection pattern.

In FIG. 9, the four optical sensors 48-1 to 48-4 are arranged in mutually different positions in the main scanning direction, but, to reduce the number of optical sensors and to reduce the size and the price, one optical sensor 48 may detect the toner adhesion amount of the fluctuation detection patterns.

Figure 10:
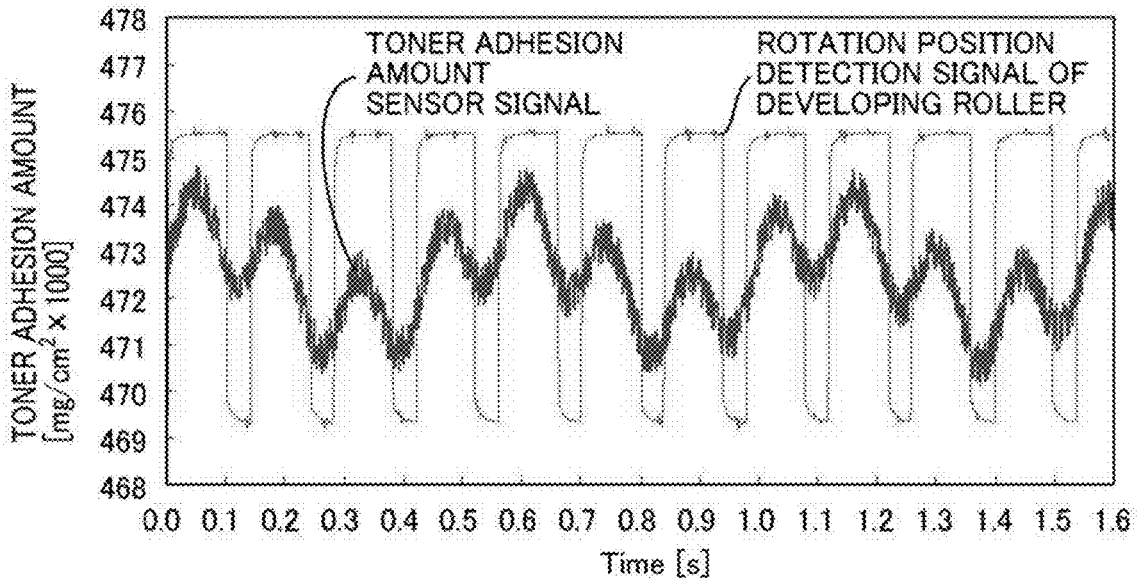
FIG. 10 is a graph illustrating an example of measurement results of the fluctuation detection pattern.

FIG. 10 is a graph illustrating an example of measurement results of the fluctuation detection pattern. In the fluctuation detection pattern thus created, image density fluctuation occurs in the sub scanning direction.

The graph in FIG. 10 represents a toner adhesion amount sensor signal that is a measurement result that the optical sensor 48 measures toner adhesion amounts in one fluctuation detection pattern. In the graph, the vertical axis indicates the toner adhesion amount [mg/cm2×1000], and the horizontal axis indicates time [sec]. The graph in FIG. 10 also represents a sensor output of a rotation position (rotation phase) of the developing roller 12. The rotation position (rotation phase) of the developing roller 12 is detected by a photo interrupter that detects a cutout portion of a light shielding plate fixed to the rotation shaft of the developing roller 12.

As illustrated in the graph of FIG. 10, periodic fluctuation occurs in the toner adhesion amount of the fluctuation detection pattern even under the image forming condition aiming at a predetermined image density, for example, 70%. In the present embodiment, the image density fluctuation controller 114 cuts out data for each rotation period of the developing roller 12 from the toner adhesion amount sensor signal of the fluctuation detection pattern based on the rotation position detection signal of the developing roller 12, performs an averaging process on the data, and specifies the image density fluctuation caused by the rotation period of the developing roller 12. In the present embodiment, because the length of the fluctuation detection pattern is set to about three times the circumferential length of the photoconductor 3, the image density fluctuation controller 114 can cut out data of ten rotation periods of developing roller 12. The averaging process is possible if there is data of two rotations, that is, a plurality of rotation periods of data. The averaging processing of data of ten rotation periods which is more than three rotation periods enables to specify the image density fluctuation occurring in the rotation period of the developing roller 12 more accurately. Such averaging process reduces an effect of periodic fluctuation having rotation period other than the rotation period of the developing roller 12 and enables to specify the image density fluctuation in the rotation period of the developing roller 12.

In the present embodiment, the image density fluctuation controller 114 similarly cuts out data for each rotation period of the photoconductor 3 from the toner adhesion amount sensor signal of the fluctuation detection pattern based on the rotation position detection signal of the photoconductor 3, performs the averaging processing on the data, and specifies the image density fluctuation caused by the rotation period of the photoconductor 3. In the present embodiment, data of three rotations of the photoconductor 3 is cut out, and averaging process for three rotations specifies the image density fluctuation occurring in the rotation period of the photoconductor 3.

Figure 11:
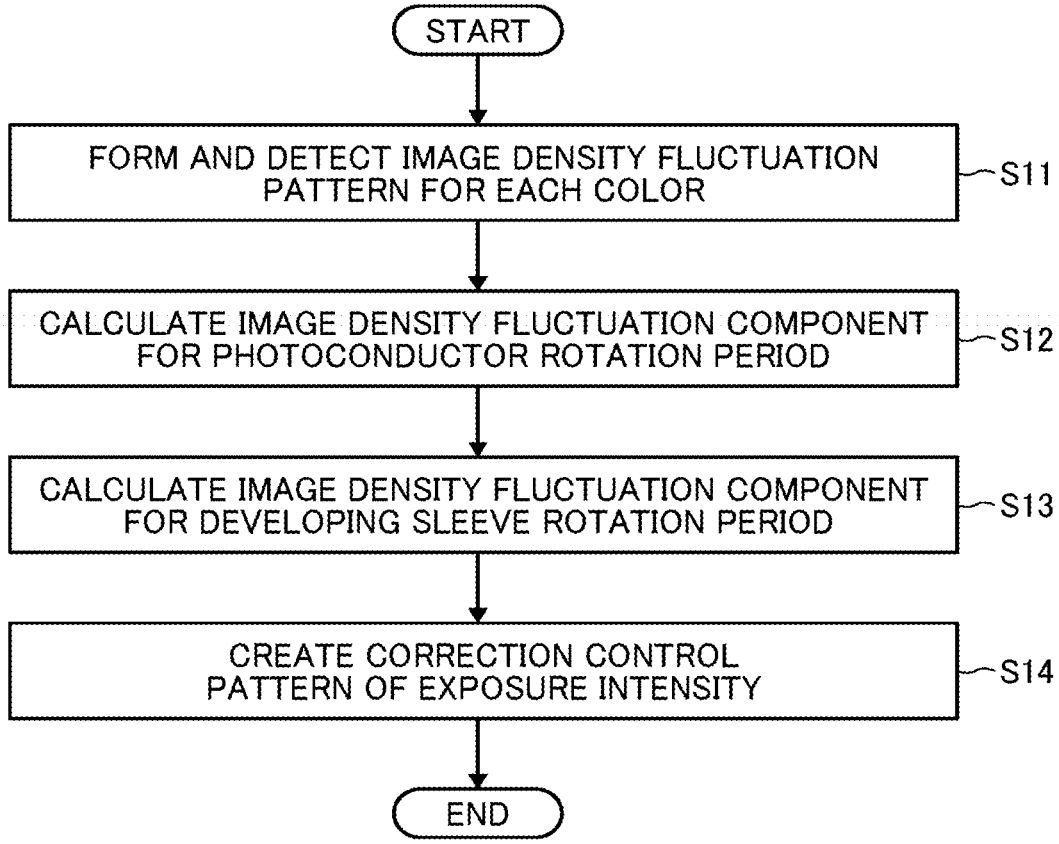
FIG. 11 is a flowchart illustrating a flow of an image density fluctuation control in the printer.

FIG. 11 is a flowchart illustrating a correction control pattern creation process in the image density fluctuation control. In the present embodiment, the correction control pattern creation process that periodically changes only the exposure intensity is described.

At an execution timing of the image density fluctuation control such as the timing of replacing the photoconductor or the developing roller, firstly, the image density fluctuation controller 114 creates the fluctuation detection pattern of each color and controls the optical sensor 48 to detect the toner adhesion amount of fluctuation detection pattern of each color in step S11. Each rotating body such as the photoconductor 3, the developing roller 12, the intermediate transfer belt 41, and the secondary transfer roller 50 rotates at a same speed as at a time of image formation, and fluctuation detection pattern of each color is created on the intermediate transfer belt 41 under the image forming condition that creates 70% image density pattern. The optical sensor 48 detects the toner adhesion amount of the fluctuation detection pattern on the intermediate transfer belt 41, and the image density fluctuation controller 114 acquires the detection result, that is, toner adhesion amount sensor signal.

Subsequently, the image density fluctuation controller 114 calculates image density fluctuation component having the rotation period of the photoconductor 3 from the periodic fluctuation in the toner adhesion amount sensor signal of the fluctuation detection pattern of each color detected as described above in step S12. The image density fluctuation controller 114 extracts a rotation period component corresponding to the rotation period of the photoconductor 3 from toner adhesion amount sensor signals of the fluctuation detection pattern of each color, that is, a plurality of toner adhesion amount detection values detected in a predetermined sampling interval, executes sine wave fitting, and acquires image density fluctuation component in the rotation period of the photoconductor 3 as a time function f1(*t*). The sine wave fitting is performed by acquiring Ai and θi up to the ith order component for each frequency component in the form of $\Sigma\{Ai\times Sin(\omega 1\times t+\theta i)\}$, for example. Here, ω1 is the angular frequency of the photoconductor 3.

The image density fluctuation controller 114 calculates an image density fluctuation component having the rotation period of the developing roller 12 from the periodic fluctuation of the toner adhesion amount sensor signals of each color detected from the fluctuation detection pattern of each color in step S13. The image density fluctuation controller 114 extracts a rotation period component corresponding to the rotation period of the developing roller 12 from toner adhesion amount sensor signals of the fluctuation detection pattern of each color, that is, a plurality of toner adhesion amount detection values detected in a predetermined sampling interval, executes sine wave fitting, and acquires image density fluctuation component in the rotation period of the developing roller 12 as a time function f2(*t*). The sine wave fitting is performed by acquiring Ai and θi up to the ith order component for each frequency component in the form of $\Sigma\{Ai\times Sin(\omega 2\times t+\theta i)\}$, for example. Here, ω2 is the angular frequency of the developing roller 12.

After obtaining, as described above, the image density fluctuation component f1(*t*) having the rotation period of the photoconductor 3 and the image density fluctuation component f2(*t*) having the rotation period of the developing roller 12, the image density fluctuation controller 114 calculates the correction control pattern S(t) of the exposure intensity due to the following equations (1) to (3) in step S14. The image density fluctuation controller 114 stores the correction control pattern S(t) in a memory, for example, as control tables S1 (*t*) and S2 (*t*) which are separately stored in the memory.

$$S(t)=S1(t)+S2(t) \tag{1}$$

$$S1(t)=A1\times f1(t) \tag{2}$$

$$S2(t)=A2\times f2(t) \tag{3}$$

A1 and A2 in the above-described equations (2) and (3) are adjustment gains. The adjustment gains A1 and A2 are parameters that change mainly due to the development capacity and are stored as preset values in the memory in advance, for example, in a form like a table, to obtain adjustment gains A 1 and A 2 appropriate for the developing ability of each color.

Figure 12:
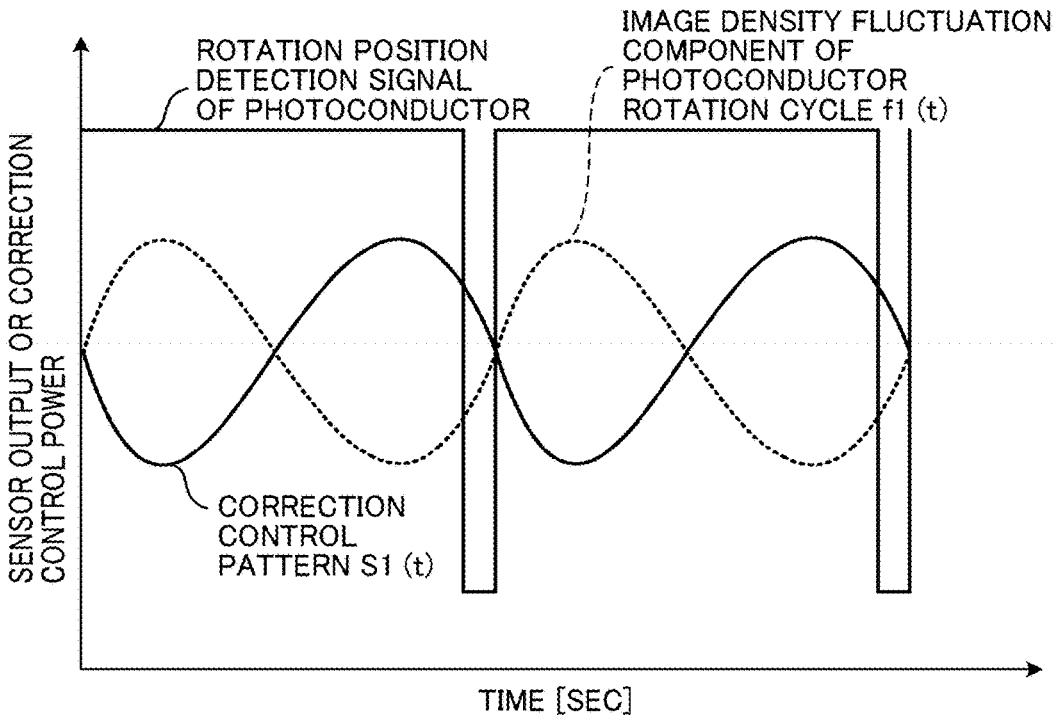
FIG. 12 is an explanatory diagram to describe a correction control pattern of the image density fluctuation control.

FIG. 12 is an explanatory diagram to describe a correction control pattern S1(*t*).

A graph illustrated in FIG. 12 describes the correction control pattern S1(*t*) for two rotation periods of the photoconductor 3 with a rotation position detection signal of the photoconductor 3 and the image density fluctuation component f1 (*t*) having the rotation period of the photoconductor 3. FIG. 12 illustrates that the correction control pattern S1(*t*) having the rotation period of the photoconductor 3 is in opposite phase to the image density fluctuation component f1(*t*) extracted at the rotation according to the rotation position detection signal and cancels the image density fluctuation component f1(*t*). The image density fluctuation controller 114 determines such the correction control pattern S1(*t*) by the process illustrated in FIG. 11.

In the image density fluctuation control during printing according to the present embodiment, the image density fluctuation controller periodically changes the image forming condition such as the developing bias, the charging bias, and an exposure condition to cancel the image density fluctuation specified as described above and reduces the image density fluctuation. As the image forming condition to be changed, following conditions are considered: (1) Only the exposure intensity, (2) Only the transfer bias, (3) Only the developing bias, (4) Only the charging bias, (5) The developing bias and the exposure intensity, (6) The developing bias and the charging bias, (7) The developing bias, the charging bias, and the exposure intensity, (8) The developing bias, the charging bias, and the transfer bias, and the like. The image density fluctuation can be reduced by changing at least one of the exposure intensity, the transfer bias, the developing bias, and the charging bias. In the present embodiment, as described above, (1) only the exposure intensity is periodically changed.

The correction control pattern S1(*t*) illustrated in FIG. 12 is synchronized with the rotation position detection signal of the photoconductor 3. When an image moving distance from an exposure position to a detection position of the optical sensor 48 is an integral multiple of the circumferential length of the photoconductor 3 and there is no linear velocity difference between the photoconductor 3, the intermediate transfer belt 41, and the secondary transfer roller 50, the correction control pattern S1(*t*) determined by this condition is applied to the exposure intensity from the beginning of the correction control pattern S1(*t*), that is, the beginning of the control table in accordance with the timing of the rotation position detection signal of the photoconductor 3. On the other hand, when an image moving distance from an exposure position to the detection position of the optical sensor 48 is not an integral multiple of the circumferential length of the photoconductor 3 or there is a linear velocity difference between the photoconductor 3, the intermediate transfer belt 41, and the secondary transfer roller 50, a timing in which the correction control pattern S1(*t*) is applied to the exposure intensity is corrected by a difference generated by this condition from the timing of the rotation position detection signal of the photoconductor 3.

Similarly, the correction control pattern S2(*t*) is synchronized with the rotation position detection signal of the developing roller 12. When an image moving distance from an exposure position to a detection position of the optical sensor 48 is an integral multiple of the circumferential length of the developing roller 12 and there is no linear velocity difference between the photoconductor 3, the intermediate transfer belt 41, and the secondary transfer roller 50, the correction control pattern S2(*t*) determined by this condition is applied to the exposure intensity from the beginning of the correction control pattern S2(*t*), that is, the beginning of the control table in accordance with the timing of the rotation position detection signal of the developing roller 12. On the other hand, when an image moving distance from an exposure position to the detection position of the optical sensor 48 is not an integral multiple of the circumferential length of the developing roller 12 or there is a linear velocity difference between the photoconductor 3, the intermediate transfer belt 41, and the secondary transfer roller 50, a timing in which the correction control pattern S2(*t*) is applied to the exposure intensity is corrected by a difference generated by this condition from the timing of the rotation position detection signal of the developing roller 12.

In the present embodiment, the image density fluctuation controller 114 executes the image density fluctuation control by periodically changing the exposure intensity, but, when the image density fluctuation controller 114 executes the image density fluctuation control by periodically changing the developing bias, the image density fluctuation controller 114 shifts a timing depending on whether an image moving distance from a development position to the detection position of the optical sensor 48 is an integral multiple of the circumferential length of the photoconductor 3 or the developing roller 12. Similarly, when the image density fluctuation controller 114 executes the image density fluctuation control by periodically changing the charging bias, the image density fluctuation controller 114 shifts a timing depending on whether an image moving distance from a charging position to the detection position of the optical sensor 48 is an integral multiple of the circumferential length of the photoconductor 3 or the developing roller 12. Similarly, when the image density fluctuation controller 114 executes the image density fluctuation control by periodically changing the transfer bias, the image density fluctuation controller 114 shifts a timing depending on whether an image moving distance from a transfer position to the detection position of the optical sensor 48 is an integral multiple of the circumferential length of the photoconductor 3 or the developing roller 12. As described above, the image density fluctuation can be reduced by changing at least one of the exposure intensity, the transfer bias, the developing bias, and the charging bias.

Next, an operation during the non-printing period performed by the non-print controller 113 illustrated in FIG. 6 is described.

In the non-printing period, the non-print controller 113 creates an adjustment pattern on the photoconductor 3 and adjusts a setting value of the image forming condition using the electric potential data regarding the adjustment pattern. The non-printing process is described. In the non-printing process, the non-print controller 113 acquires the electric potential data regarding the adjustment pattern created on the photoconductor 3 during the non-printing period and calculates various kinds of estimation equations to use the adjustment of the setting value of the image forming condition in the image density adjustment control from the acquired electric potential data.

Figure 13:
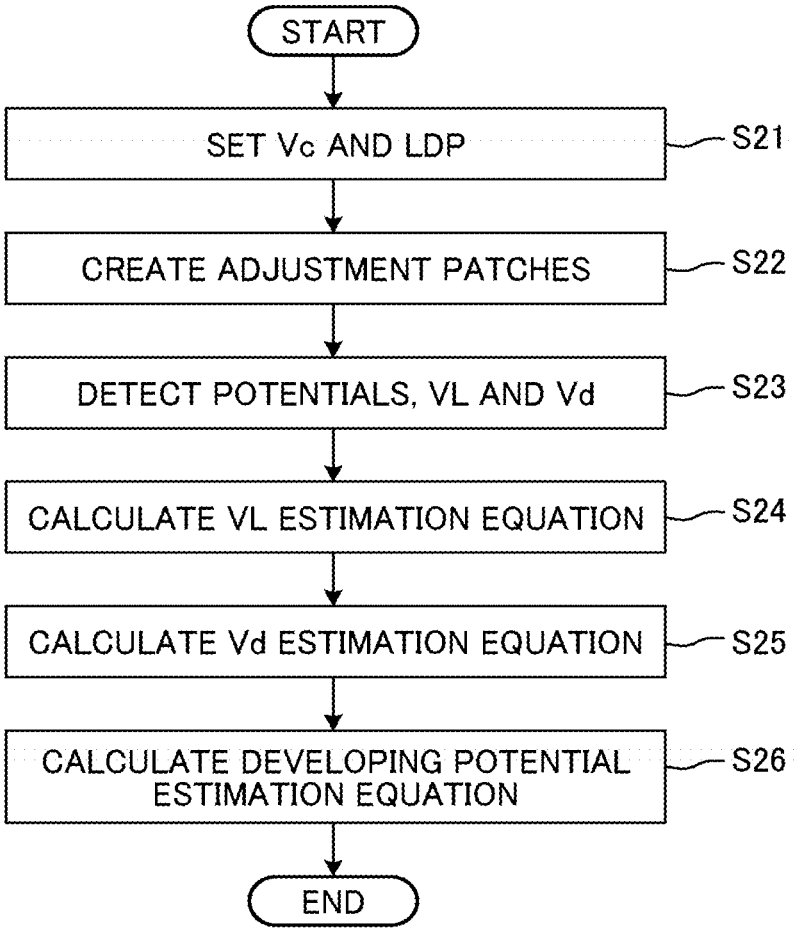
FIG. 13 is a flowchart illustrating a flow of a non-printing process in the printer.

FIG. 13 is a flowchart illustrating the non-printing process controlled by the non-print controller 113.

In the non-printing process, the non-print controller 113 firstly creates a plurality of adjustment patches in the adjustment pattern having an image area rate of 100% on the photoconductor 3 by using a plurality of set of different charging biases Vc and different exposure intensities LDP during the non-printing period such as time immediately after the process control in steps S21 and S22. In step S23, the potential sensor 18 disposed opposite to the surface of the photoconductor 3 detects the exposure potential VL and a background portion potential Vd which is an electric potential at a non-image portion of the photoconductor 3. For example, as illustrated in FIG. 2, the potential sensor 18 is disposed opposite to the surface of the photoconductor 3 between the exposure position by the writing unit 20 and the development area by the developing unit 7 in the rotation direction of the photoconductor 3. The potential sensor 18 detects the potential on the surface of the photoconductor 3 after a charging process by the charger 5 and an exposure process by the writing unit 20 and before a developing process by the developing unit 7.

Each adjustment patch of the present embodiment is created by changing the charging bias Vc and the exposure intensity LDP to obtain, for example, the solid image density that is an image density of an image having image area rate of 100%. However, when there is an image density or a gradation area for which it is desired to stably obtain the target image density especially, for example, when stably obtaining a halftone image density with an image area rate of 50% is desired, the adjustment patch having the other image density other than the solid image density may be used. In addition, as the image area rate of the black toner image increase, the sensitivity of the optical sensor 48 tends to decrease. Therefore, a black adjustment pattern may be a relatively low image density pattern because change of the toner adhesion amount in the black adjustment pattern having the image area rate of 100% is difficult to detect.

The length of the adjustment patch in the sub-scanning direction may be equal to or larger than the circumferential length of the developing roller 12 or the circumferential length of the photoconductor 3 to reduce influence of the periodic fluctuation caused by the developing roller 12 of the developing unit 7 or the photoconductor 3.

As described above, the potential sensor 18 detects the exposure potential VL and the background portion potential Vd of each adjustment patch in the adjustment pattern made with an image area ratio of 100% using a plurality of sets with different charging biases Vc and different exposure intensities LDP from step S21 to step S23. Based on the setting values of the charging biases Vc and the exposure intensities LDP when each adjustment patch in the adjustment pattern is created and the detected exposure potential VL, the non-print controller 113 calculates a VL estimation equation to estimate the exposure potential VL as follows in step S24.

Figure 14:
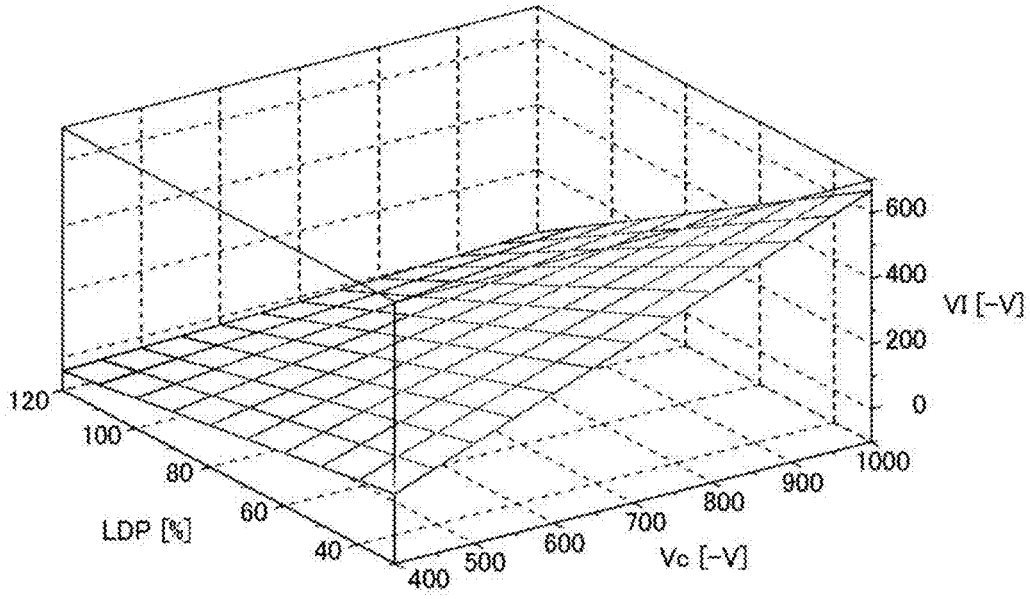
FIG. 14 is a graph of an estimation equation of exposure potential VL calculated in the non-printing process.

As illustrated in the following equation (4), the VL estimation equation is expressed by a function of the setting values of the charging biases Vc and the exposure intensities LDP when each adjustment patch in the adjustment pattern is created and the detected exposure potential VL of each adjustment patch. An approximation formula using the least squares method or the like may be used as the estimation equation. The graph of the VL estimation equation is, for example, illustrated in FIG. 14. In this graph, X axis indicates the exposure intensity LDP, Y axis indicates the charging bias Vc, and Z axis indicates the exposure potential VL. This graph represents a plane specified by the VL estimation equation.

$$VL=fVL\{Vc,LDP\} \tag{4}$$

As illustrated in the following equation (5), the Vd estimation equation to estimate the background portion potential is expressed by a function of the setting values of the charging biases Vc when each adjustment patch in the adjustment pattern is created and the detected background portion potential Vd in step S25. An approximation formula using the least squares method or the like may be used as the estimation equation.

$$Vd=fVd\{Vc\} \quad (5)$$

In calculating the VL estimation equation and the Vd estimation equation, as a number of adjustment patches increase, estimation accuracy of the estimation equations become higher. The number of adjustment patches is determined in consideration of the time needed for creating the adjustment pattern, a calculation load for calculating the VL estimation equation and the Vd estimation equation, any increase in required memory capacity, and a measurement accuracy of the optical sensor 48.

The developing potential estimation equation is calculated as follows in step S26.

The non-print controller 113 calculates the development potential that is the developing bias Vb when each adjustment patch in the adjustment pattern is created from a following equation (6) based on a setting value of the charging bias Vc when each adjustment patch is created and the background potential predetermined by experiments in advance.

$$Vb=Vc-(\text{background potential}) \quad (6)$$

The non-print controller 113 calculates the developing potential MaxPot of each adjustment patch using the development potential Vb calculated by the above equation (6), the exposure potential VL calculated by the above equation (4) that is the VL estimation equation, and the background portion potential Vd calculated by the above equation (5) that is the Vd estimation equation. The non-print controller 113 calculates the developing potential estimation equation as illustrated in a following equation (7) based on the developing potential MaxPot of each adjustment patch calculated as described above. The developing potential estimation equation is expressed by a function of the developing potential MaxPot, the charging bias Vc, and the exposure intensity LDP.

$$\text{MaxPot}=g1\{Vc,LDP\} \quad (7)$$

Figure 15:
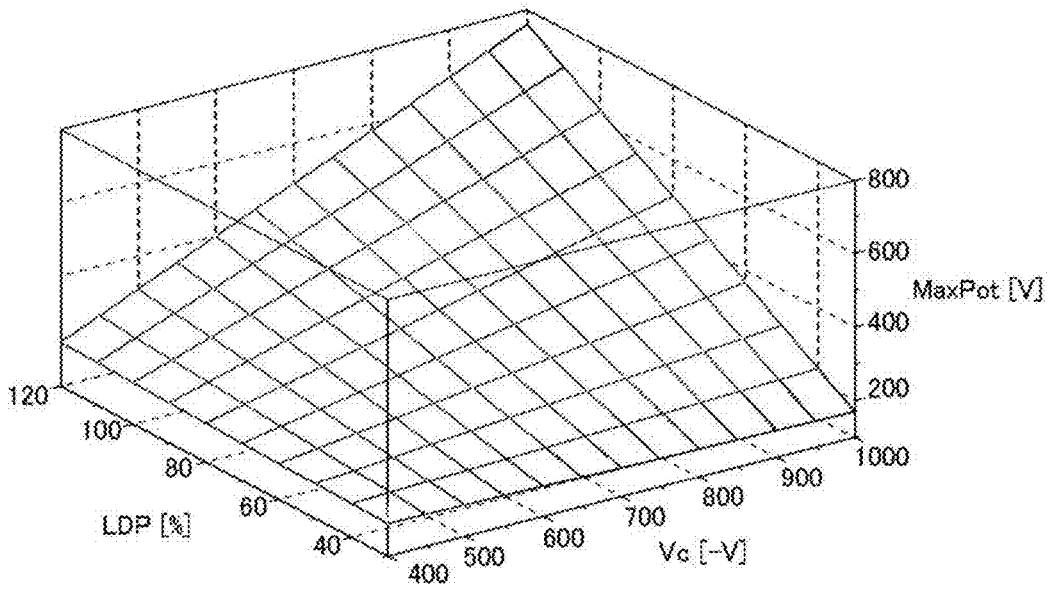
FIG. 15 is a graph of a developing potential estimation equation calculated in the non-printing process.

The graph of the developing potential estimation equation is, for example, illustrated in FIG. 15. In this graph, X axis indicates the exposure intensity LDP, Y axis indicates the charging bias Vc, and Z axis indicates the developing potential MaxPot. This graph represents a plane specified by the developing potential estimation equation.

A description is provided of an operation of the image density adjustment control during printing performed during the image formation period.

Figure 16:
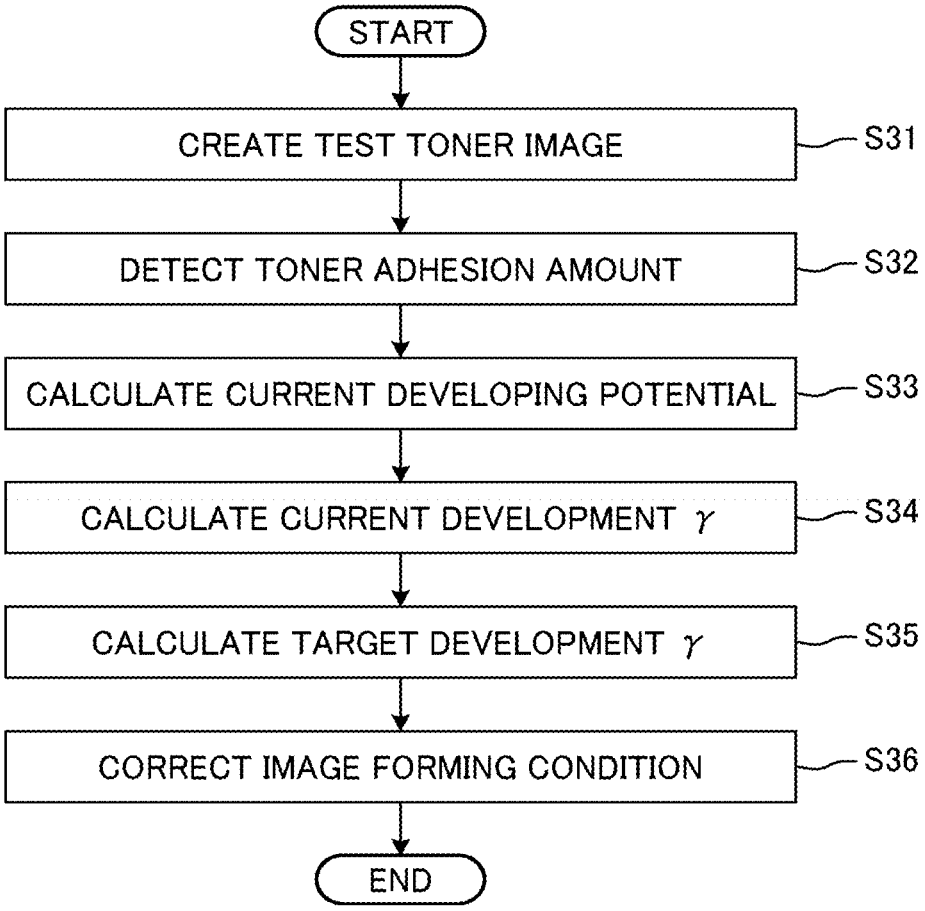
FIG. 16 is a flowchart illustrating a flow of an image density adjustment control during printing in the printer.

FIG. 16 is a flowchart illustrating an image density adjustment control during printing controlled by the print controller 112 in FIG. 6.

The print controller 112 executes the image density adjustment control during printing at a predetermined timing such as after a predetermined number of images are formed or after a predetermined time has elapsed since the image forming operation period started. "the printing period" means, for example, the printing period when each of a plurality of images is continuously formed on each of a plurality of sheets or the printing period when a plurality of images are printed on continuous form paper. The present embodiment is the former because the image is formed on a cut form sheet.

When the time of the image density adjustment control during printing comes, at a predetermined timing, the print controller 112 creates test toner images of respective colors in the unused area in step S31. It is preferable that the gradation area that is the image density of the test toner image is set to the same gradation area that is the image density as the adjustment pattern created at the non-printing process described above. This is because use of the test toner image created to have the same image density as the adjustment pattern enables direct use of the developing potential estimation equation and simple processing because the print controller 112 uses the developing potential estimation equation calculated from the potential data of the adjustment pattern in the non-printing process. Therefore, in the present embodiment, the print controller 112 creates the test toner image to obtain a solid image density of which the image area rate is 100% like the adjustment pattern.

Figure 17A:
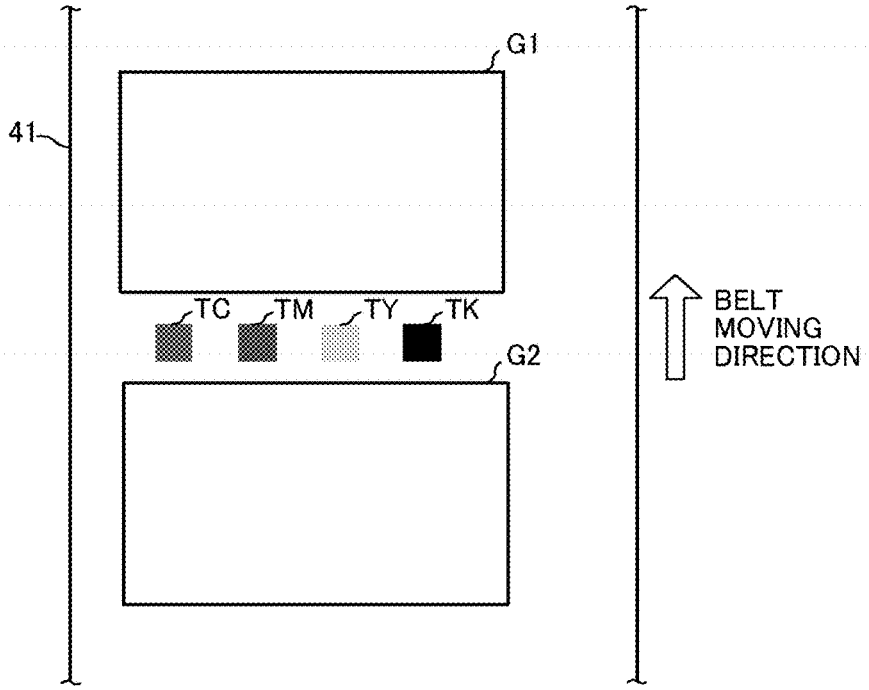
FIG. 17A is an explanatory diagram illustrating an example in which a test toner image of each color is created in an interval between two image forming areas arranged in the sub scanning direction.
Figure 17B:
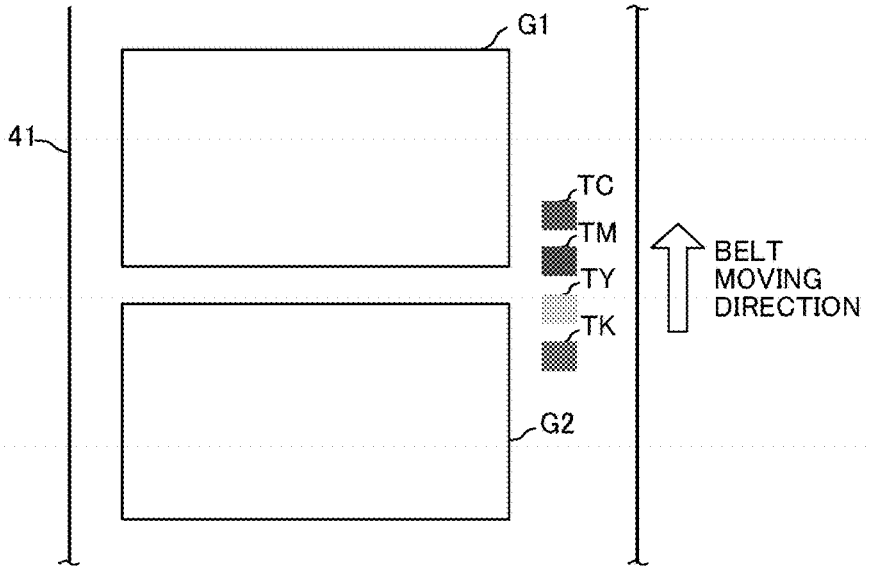
FIG. 17B is an explanatory diagram illustrating an example in which the test toner image of each color is created in a lateral area on the outer side in the main scanning direction of the image forming area.

The unused area in which the test toner image of each color is created is an area in which a toner image can be formed but is not an image formation area in which one image formed on one sheet of recording paper P can be formed. For example, as illustrated in FIG. 17A, test toner images TY, TC, TM, and TK of respective colors may be created in an area (an interval) between two image formation areas G1 and G2 arranged in the sub-scanning direction. Or, for example, as illustrated in FIG. 17B, test toner images TY, TC, TM, and TK of respective colors may also be created in an area (a lateral area) outside of the image formation areas G1 and G2 in the main scanning direction. In the present embodiment, as described later, the optical sensors 48-1 to 48-4 described above detect the toner adhesion amounts of the test tone images of respective colors. Therefore, as illustrated in FIG. 17A, the test toner images TY, TC, TM, and TK are created in the interval between sheets. It is preferable that the sizes of the test toner images TY, TC, TM and TK, at least, the size in the main scanning direction, are equal to or greater than a target area (a spot diameter of the LED) of the optical sensors 48-1 to 48-4.

When the test toner images TY, TC, TM, and TK are formed in the lateral area as illustrated in FIG. 17B, the optical sensor may be separately disposed at a position corresponding to the lateral area in the main scanning direction. The optical sensor to detect the toner adhesion amount of the test toner image may be either the one which detects the test toner image on the intermediate transfer belt 41 or the one which detects the test toner image on the photoconductor 3. When lengths of the test toner images TY, TC, TM, and TK of respective colors is set equal to or longer than the circumferential length of the developing roller 12 or the photoconductor 3 to reduce the influence of the periodic fluctuation caused by the developing roller 12 or the photoconductor 3, creating the test toner images TY, TC, TM, and TK in the lateral area is preferable because creating the test toner images TY, TC, TM, and TK in the interval between sheets enlarges the interval between sheets and lowers productivity of images.

The optical sensors 48-1 to 48-4 detect the toner adhesion amounts in the test toner images TY, TC, TM, and TK of each color created in the interval between sheets in step S32. In step S33, the print controller 112 illustrated in FIG. 6 calculates the current developing potential MaxPot based on the setting value of the charging bias Vc and the exposure intensity LDP when the test toner images are created, using the developing potential estimation equation that is the above equation (7) calculated in the non-printing process. In the calculation of this developing potential MaxPot, the print controller 112 uses the potential measured in the non-printing process in the flowchart of FIG. 13. In step S34, the print controller 112 calculates the current development γ using the calculated developing potential MaxPot, the toner adhesion amount detection results (measured values) of the test toner images by the optical sensors 48-1 to 48-4, and the development threshold voltage Vk obtained at the above process control.

Figure 18:
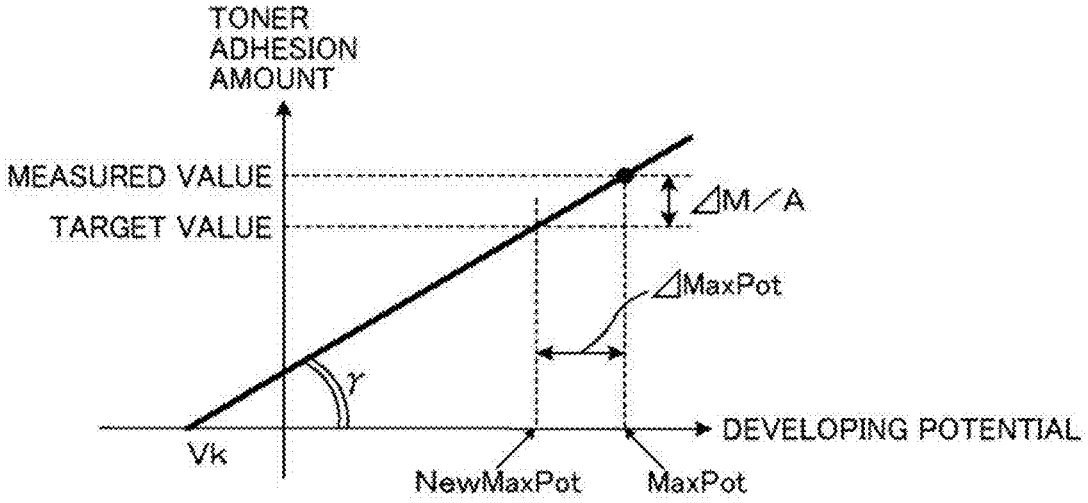
FIG. 18 is a graph illustrating estimation of a development γ obtained from a calculated developing potential, a toner adhesion amount detection result of the test toner image that is a measurement value, which are obtained by the image density adjustment control during printing, and a development threshold voltage obtained by process control.

FIG. 18 is a graph illustrating estimation of the development γ obtained from the calculated developing potential MaxPot, the toner adhesion amount detection results (measured values) of the test toner images TY, TC, TM, and TK by the optical sensors 48-1 to 48-4, and the development threshold voltage Vk obtained at the above process control. In the graph, the horizontal axis indicates the developing potential, and the vertical axis indicates the toner adhesion amount. The print controller 112 draws a straight line connecting one point determined from the calculated developing potential MaxPot and each of values measured by the optical sensors 48-1 to 48-4 and one point determined from the development threshold voltage Vk and calculates the inclination of this straight line as the development γ.

After calculating the development γ, the print controller 112 calculates a target developing potential NewMaxPot by using the calculated development γ and the development threshold voltage Vk to obtain a target toner adhesion amount in step S35. The target toner adhesion amount is the toner adhesion amount necessary for obtaining the solid image density and is the same as the target toner adhesion amount in the process control described above. The target toner adhesion amount may be determined by experiments in advance or determined based on the toner adhesion amount detection result when the optical sensors 48-1 to 48-4 detect the gradation pattern created at the process control described above.

A method of calculating the target developing potential NewMaxPot is as follows. The print controller 112 firstly calculates a difference ΔM/A between the target toner adhesion amount and the toner adhesion amount detection result (measured value) of each of the test toner images TY, TC, TM, and TK detected by the optical sensors 48-1 to 48-4. Next, based on the calculated difference ΔM/A and the current development γ calculated in step S34, the print controller 112 calculates the difference ΔMaxPot between the current developing potential MaxPot calculated in step S33 and the target developing potential NewMaxPot. Then, using the calculated difference ΔMaxPot, the print controller 112 calculates the target developing potential NewMaxPot from the current developing potential MaxPot calculated in step S33.

After calculating the target developing potential NewMaxPot for obtaining the target toner adhesion amount in this manner, the print controller 112 adjusts the setting value of the image forming condition in step S36. In the present embodiment, the print controller 112 determines setting values of the charging bias Vc and the exposure intensity LDP from the calculated target developing potential NewMaxPot by using the developing potential estimation equation (above-described equation (7)) calculated in the non-printing process. That is, from the target developing potential NewMaxPot, the print controller 112 determines the set of the charging bias Vc and the exposure intensity LDP satisfying the following equation (8).

$$g1\{Vc,LDP\}=\text{NewMaxPot} \tag{8}$$

Figure 19:
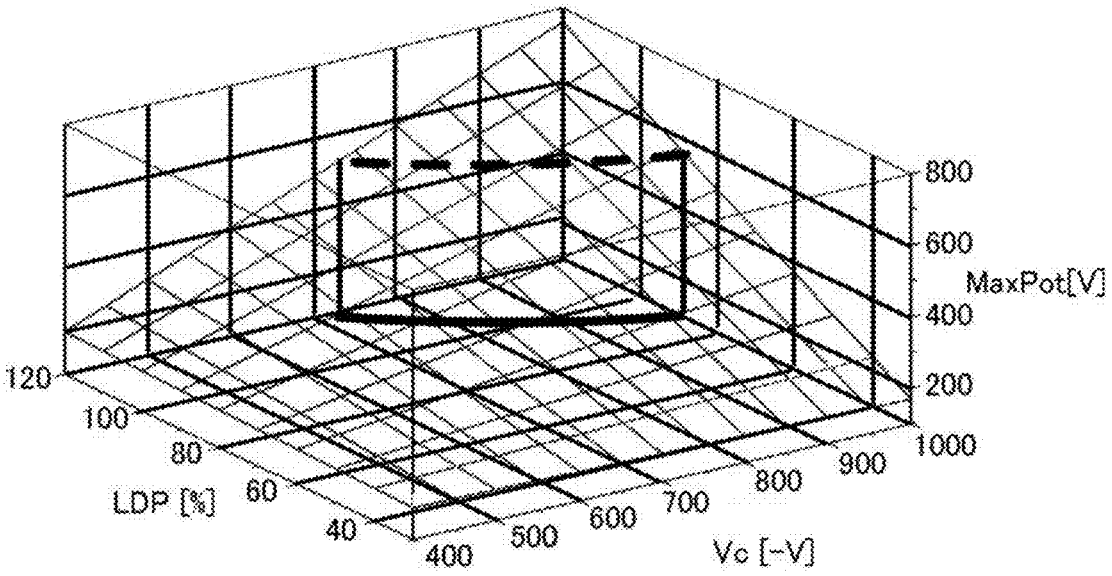
FIG. 19 is a graph illustrating sets of a charging bias and an exposure intensity determined from a target developing potential on the graph of the developing potential estimation equation illustrated in FIG. 15.

FIG. 19 is a graph illustrating sets of the charging bias Vc and the exposure intensity LDP which are determined from a target developing potential NewMaxPot on the graph determined by the developing potential estimation equation illustrated in FIG. 15, which is data stored in the image forming apparatus.

The sets of the charging bias Vc and the exposure intensity LDP satisfies the above equation (8) and are illustrated by a thick solid line on the graph illustrated in FIG. 19. The thick solid line is obtained by projecting a thick broken line on the X-Y plane. The thick broken line is obtained by cutting the face determined by the developing potential estimation equation on the graph illustrated in FIG. 19 at a height of the target developing potential NewMxaPot on the z axis. Setting the set of the charging bias Vc and the exposure intensity LDP on the thick solid line becomes a correction that leads the toner adhesion amount on the solid image to the target toner adhesion amount.

There is a plurality of sets of the charging bias Vc and the exposure intensity LDP on the thick solid line. If the image density adjustment control during printing greatly changes the setting value from the setting value before the image density adjustment, a toner adhesion amount of an image density other than the solid image density that is a gradation area may deviate from its target value. Therefore, the print controller 112 selects the set of the charging bias Vc and the exposure intensity LDP with the smallest change from the sets before the image density adjustment.

As a method of selecting the charging bias Vc and the exposure intensity LDP, the print controller 112 may change only the charging bias Vc and keep the exposure intensity LDP. Or the print controller 112 may change only the exposure intensity LDP and keep the charging bias Vc. A change of these setting values is preferably the smallest. When the print controller 112 changes both of the charging bias Vc and the exposure intensity LDP, the print controller 112 may select a set in which the square sum of the change amount of the exposure intensity LDP and the change amount of the charging bias Vc becomes the smallest.

After adjusting the setting value of the charging bias Vc and the exposure intensity LDP as described above, the print controller 112 calculates the exposure potential VL from the adjusted setting value of the charging bias Vc and the exposure intensity LDP by using the exposure potential estimation equation that is the above equation (4) calculated in the non-printing process in advance. Similarly, the print controller 112 calculates the developing potential MaxPot from the adjusted setting value of the charging bias Vc and the exposure intensity LDP using the developing potential estimation equation that is the above equation (7) calculated in the non-printing process in advance. As described above, since the relation between the developing bias Vb and the developing potential satisfies the relational expression of the developing bias Vb [−V]=the developing potential [−V]+the exposure potential VL [−V], the print controller 112 calculates the developing bias Vb based on the following equation (9).

$$Vb=\text{MaxPot}+VL \tag{9}$$

After the print controller 112 calculates the setting value of the adjusted image formation condition such as the charging bias Vc, the exposure intensity LDP, and the developing bias Vb, the control device 100 controls the charger 5, the writing unit 20, and the developing unit 7 using the setting value to execute the image forming operation after that time.

Changing the setting value of the image formation condition during image formation in the image forming area changes an image density in an image formed in the image formation area and deteriorates image quality of the formed image. Therefore, changing the setting value is preferably executed at a timing corresponding to the interval between sheets. However, when the above-described test toner image is formed in the interval between sheets where the setting value of the image formation condition is changed, because changing the setting value at a timing of the image formation of the test toner image may prevent suitable adjustment in the image density adjustment control during printing using the test toner image, the print controller 112 changes the setting value in the interval between sheets avoiding the timing of the image formation of the test toner image, that is, a test toner image area. Or the print controller 112 may change the setting value in the interval between sheets in which the test toner image is not created.

According to the present embodiment, even when factors such as environmental changes and parts deterioration during the image forming operation period may degrade image quality, the image density adjustment control during printing can adjust the setting value of the image forming condition. This enables early image quality improvement before the process control that is the image density adjustment control during the non-printing period.

In the image density adjustment control during printing according to the present embodiment, the print controller 112 determines the setting value of the image forming condition adjusted based on the detection result of the toner adhesion amount of the test toner image TY, TC, TM, and TK formed on the interval between sheets that is the unused area using the potential data that is the exposure potential VL and the background portion potential Vd of the adjustment pattern created on the surface of the photoconductor 3 in the non-printing process executed during the non-printing period. Therefore, the print controller 112 can appropriately adjust the setting value of the image forming condition during printing without being influenced by the change in the characteristics of the developer such as a toner charge from the non-printing period.

Furthermore, in the present embodiment, the potential data such as the exposure potential VL and the background portion potential Vd relating to the adjustment pattern used for the image density adjustment control during printing is acquired during the non-printing process performed during the non-printing period. Therefore, it is unnecessary to prepare the adjustment pattern and acquire the potential data during printing. Therefore, even when it is difficult to measure the potential by the potential sensor during printing, the print controller 112 can use the potential data and perform the image density adjustment control during printing.

First Variation

Next, descriptions are given below of an image density adjustment control during printing according to a first variation.

In the above-described embodiment, the test toner image used for the image density adjustment control during printing is only the test toner image of solid image density, but in the first variation, the print controller 112 uses two types of test toner images corresponding to a plurality of image densities, that is, the solid image density having the image area ratio of 100% and a halftone image density having the image area ratio of 50% and performs the image density adjustment control during printing. The plurality of image densities may be different image densities and do not need to include the solid image density. The halftone image density is not limited to 50%. For example, when the halftone image density of the image area ratio of 30% is an image density desired to be preferentially close to the target image density, the print controller 112 may use a test toner image having a halftone image density of image area ratio of 30%.

In the first variation, the adjustment pattern created in the non-printing process to calculate the developing potential estimation equation used in the image density adjustment control for printing period includes patches having the same image densities as the two types of test toner images used in the image density adjustment control for printing period. The adjustment pattern created in the non-printing process does not necessarily have to include the patch with the same image density as the test toner image. However, when the adjustment pattern created in the non-printing process does not include the patch with the same image density as the test toner image, a calculation process to compensate for the image density difference in the image density is required. Therefore, it is preferable that the patch in the adjustment pattern and the test toner image have the same image density.

Figure 20:
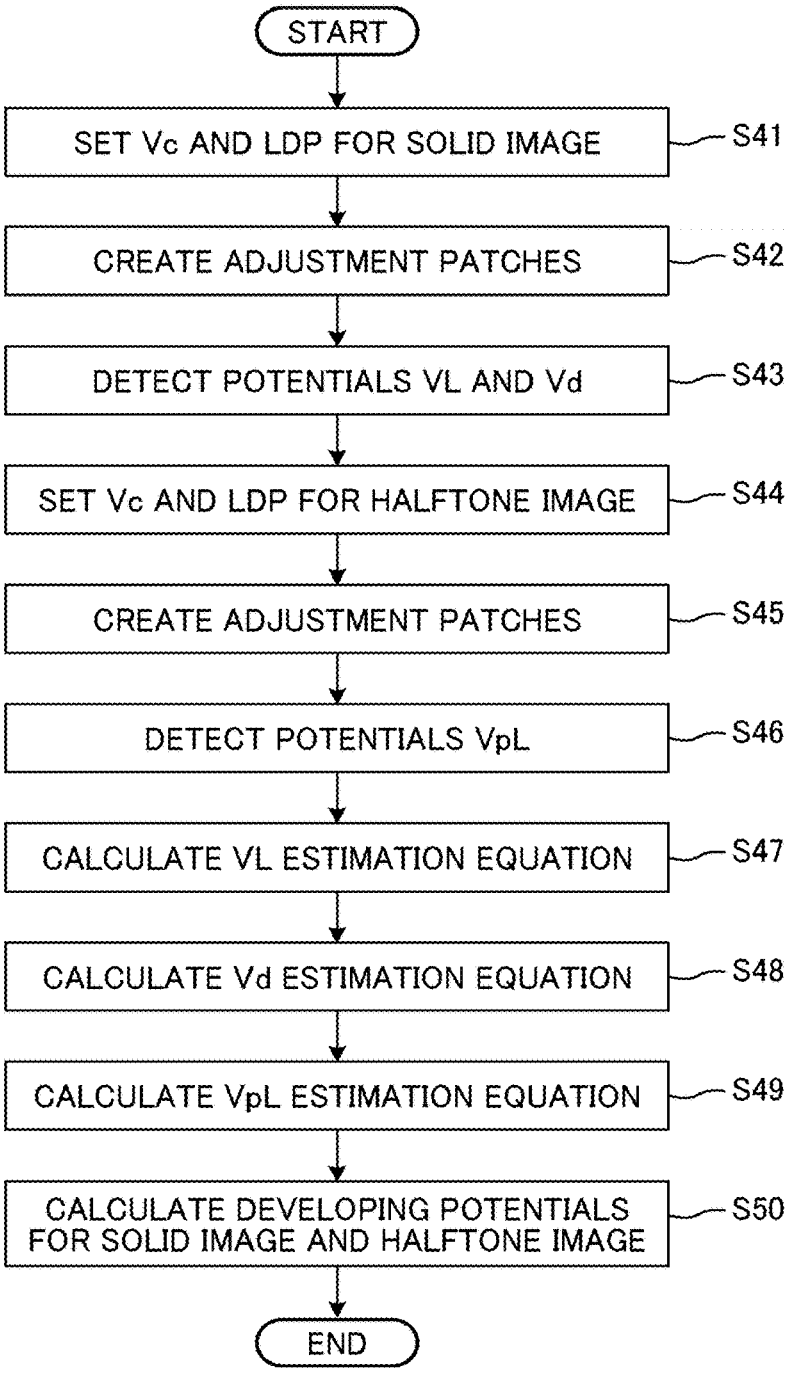
FIG. 20 is a flowchart illustrating a flow of the non-printing process according to a first variation.

FIG. 20 is a flowchart illustrating a non-printing process according to the first variation.

The non-print controller 113 illustrated in FIG. 6 executes the non-printing process according to the first variation. As in the above-described embodiment, the non-print controller 113 firstly creates a plurality of adjustment patches having an image area rate of 100% on the photoconductor 3 by using a plurality of sets of different charging biases Vc and different exposure intensities LDP during the non-printing period in steps S41 and S42 and acquires potential data that is the exposure potential VL corresponding to the solid image density and the background portion potential Vd in step S43. Subsequently, the non-print controller 113 uses a plurality of sets of different charging biases Vc and different exposure intensities LDP to form a plurality of adjustment patches at the image area rate of 50% on the surface of the photoconductor 3 in steps S44 and S45 and acquires the potential data of halftone exposure portion potential VpL in step S46.

As in the above-described embodiment, in step S47, based on the setting values of the charging biases Vc and the exposure intensities LDP when each adjustment patch of the solid image density is created and the detected exposure potential VL, the non-print controller 113 calculates a VL estimation equation to estimate the exposure potential corresponding to the solid image density as in the above-described equation (4).

As in the above-described embodiment, in step S48, the Vd estimation equation to estimate the background portion potential Vd is calculated by using the detected background portion potential Vd and the charging biases Vc when each adjustment patch of the solid image density is created as in the above-described equation (5).

Additionally, in the first variation, the non-print controller 113 calculates a VpL estimation equation to estimate the halftone exposure portion potential VpL like the following equation (10) from the setting values of the charging biases Vc and the exposure intensities LDP when each adjustment patch of the halftone image density is created and the detected halftone exposure portion potential VpL in step S49.

$$VpL=fVpL\{Vc,LDP\} \tag{10}$$

After calculating the VL estimation equation, the Vd estimation equation, and the VpL estimation equation as described above, the non-print controller 113 calculates a solid image developing potential estimation equation to estimate the developing potential corresponding to the solid image density (hereinafter, referred to as a solid image developing potential MaxPot) and a halftone image developing potential estimation equation to estimate the developing potential corresponding to the halftone image density (hereinafter, referred to as a halftone image developing potential HtPot) in step S50.

As in the above-described embodiment, the solid image density developing potential estimation equation is calculated as follows. The non-print controller 113 calculates the development potential that is the developing bias Vb when each adjustment patch having the solid image density is created based on the setting value of the charging bias Vc when each adjustment patch of the solid image density is created and the background potential. Using the calculated development potential Vb, the VL estimation equation described above (the equation (4)), and the Vd estimation equation described above (the equation (5)), the non-print controller 113 calculates the developing potential MaxPot for each adjustment patch of the solid image density. The non-print controller 113 calculates the solid image density developing potential estimation equation as illustrated in the equation (7) based on the developing potential MaxPot of each adjustment patch calculated as described above.

On the other hand, a halftone image developing potential estimation equation is calculated as follows. Using the development potential Vb obtained when the non-print controller 113 calculates the solid image density developing potential estimation equation, the above-described VpL estimation equation (the equation (10)) and the above-described Vd estimation equation (the equation (5)), as in the solid image density developing potential estimation equation, the non-print controller 113 calculates the halftone image developing potential HtPot for each adjustment patch of halftone image density. The non-print controller 113 calculates the halftone image developing potential estimation equation as illustrated in a following equation (11) based on the halftone image developing potential HtPot of each adjustment pattern calculated as described above.

$$HtPot=g2\{Vc,LDP\} \tag{11}$$

A description is provided of an operation of the image density adjustment control during printing according to the first variation.

Figure 21:
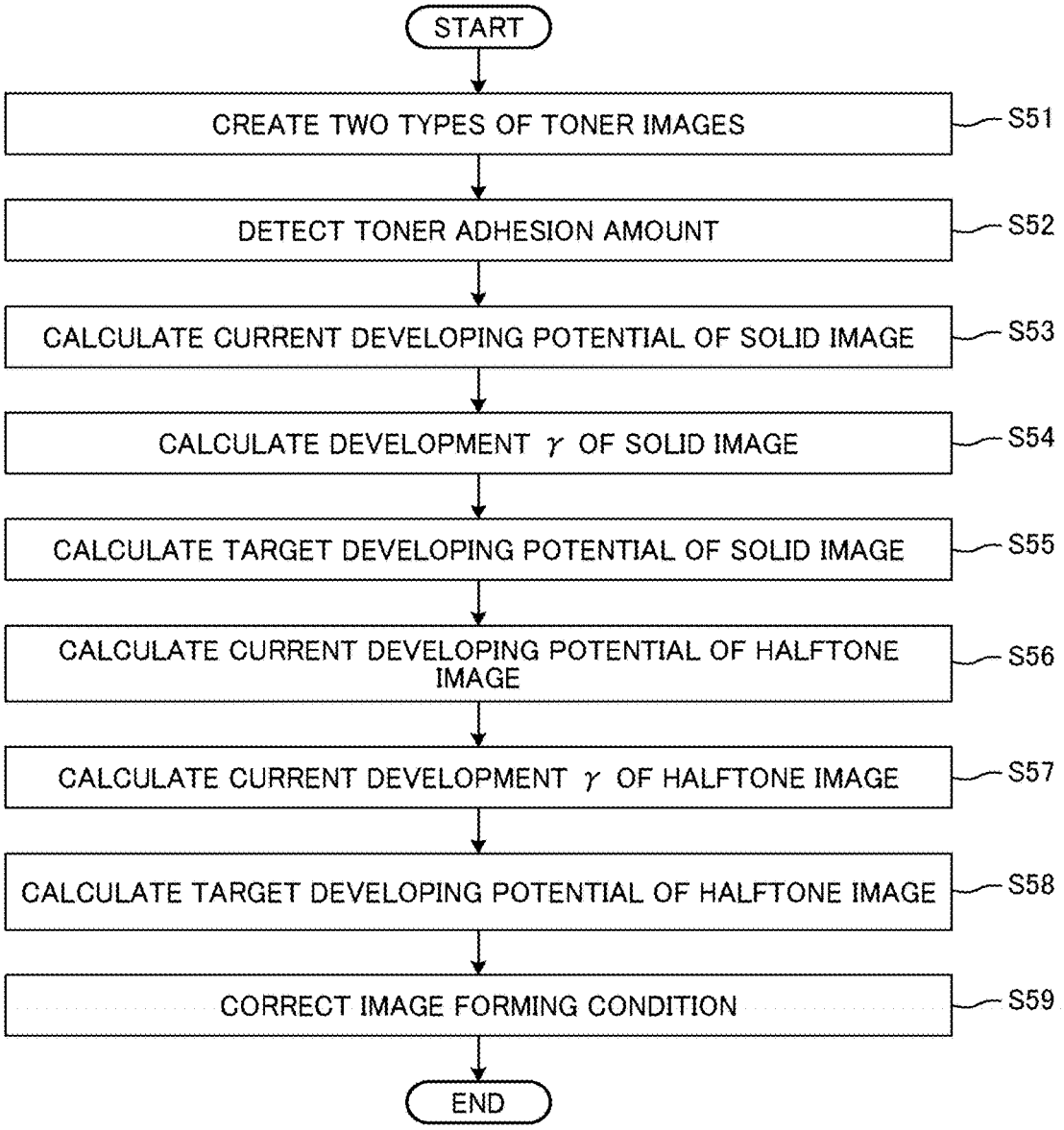
FIG. 21 is a flowchart illustrating an image density adjustment control during printing according to the first variation.

FIG. 21 is a flowchart illustrating the image density adjustment control during printing according to the first variation. This flowchart is an alternative to the flowchart illustrated in FIG. 16.

when a time of the image density adjustment control during printing comes, at a predetermined timing, the print controller 112 creates test toner images of respective colors in the non-image forming area. In the first variation, as described above, the print controller 112 creates two types of test toner images corresponding to a plurality of image densities, that is, the solid image density having the image area ratio of 100% and a halftone image density having the image area ratio of 50% in step S51.

Figure 22:
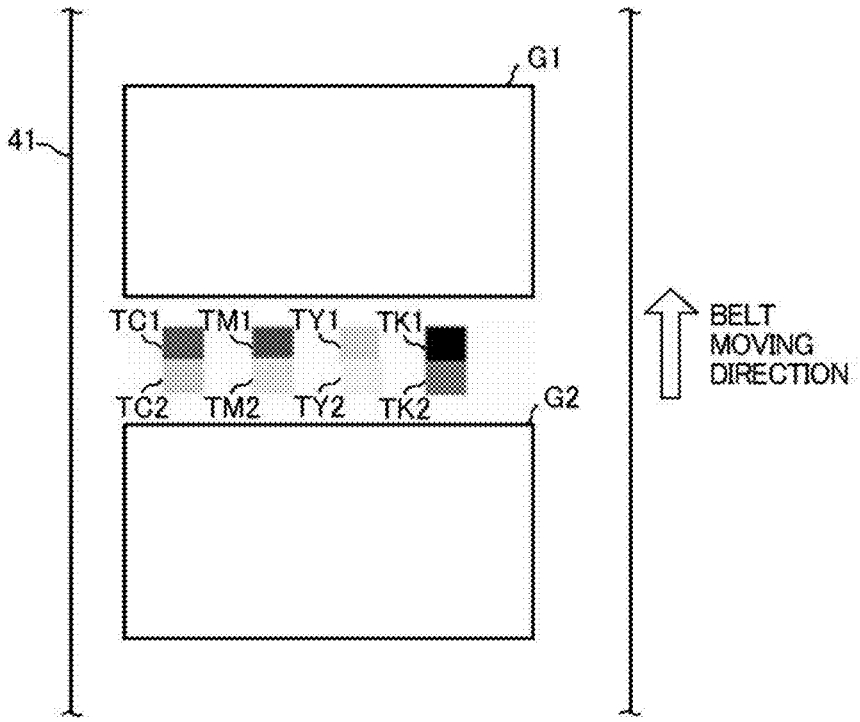
FIG. 22 is an explanatory diagram illustrating an example in the image density adjustment control during printing in which two types of test toner image of each color are created in an interval between two image forming areas arranged in the sub scanning direction.

As a method of creating two types of test toner images in the unused area, for example, as illustrated in FIG. 22, two types of test toner images for each color TY1, TC1, TM1, TK1, TY2, TC2, TM2, and TK2 may be created in the area (the interval between sheets) between two image formation areas G1 and G2 arranged in the sub-scanning direction. In the example illustrated in FIG. 22, two types of test toner images of solid image density and halftone image density are continuously created in the sub-scanning direction for each color, and each of the optical sensors 48-1 to 48-4 detects the toner adhesion amounts of two types of test toner images for each color.

Figure 23:
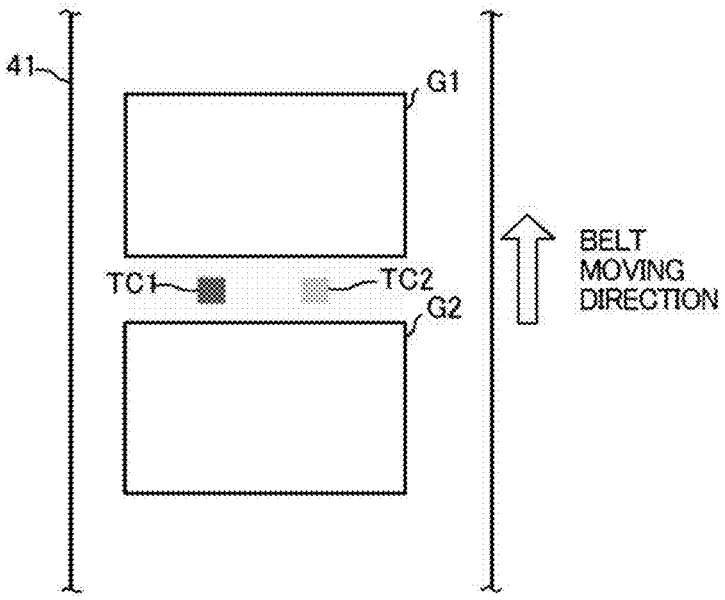
FIG. 23 is an explanatory diagram illustrating an example in the image density adjustment control during printing in which two types of test toner images are formed in a main-scanning direction in the interval.

When the interval between sheets is too short in the sub-scanning direction to create the two types of the test toner images continuously in the sub-scanning direction, as illustrated in FIG. 23, the print controller 112 may create the two types of the test toner images side by side in the main scanning direction and control the separate optical sensors 48-1 to 48-3 to detect the toner adhesion amounts of the test toner images. In the example illustrated in FIG. 23, two types of test toner images of one color are created in each interval between sheets, but if the number of optical sensors arranged side by side in the main scanning direction is sufficient, two types of test toner images of two or more colors may be created in one interval between sheets. It is not always necessary to create two types of test toner images for the same color in the same interval between sheets.

Figure 24:
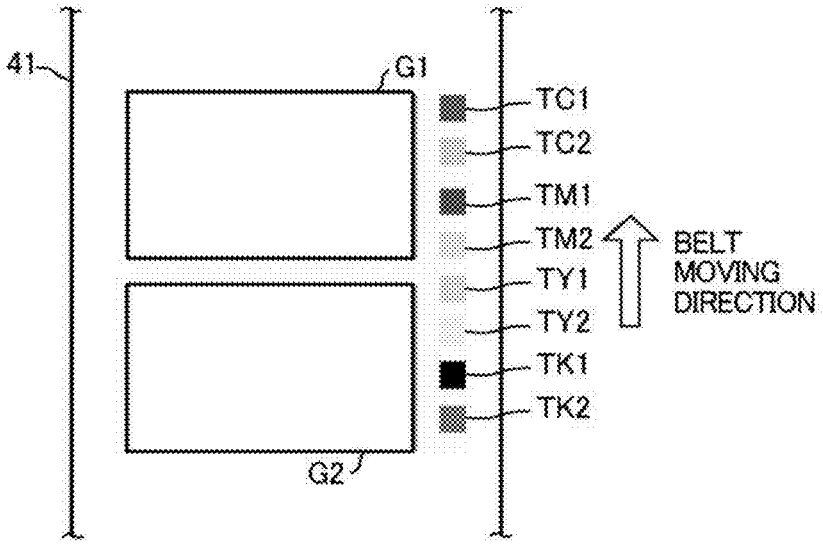
FIG. 24 is an explanatory diagram illustrating an example in which two types of test toner images of each color are created in a lateral area on the outer side in the main scanning direction of the image forming area in the image density adjustment control during printing.

Or, for example, as illustrated in FIG. 24, two types of test toner images for each color TY1, TC1, TM1, TK1, TY2, TC2, TM2, and TK2 may be created in the area (the lateral area) outside of the image formation areas G1 and G2 in the main scanning direction.

Figure 25:
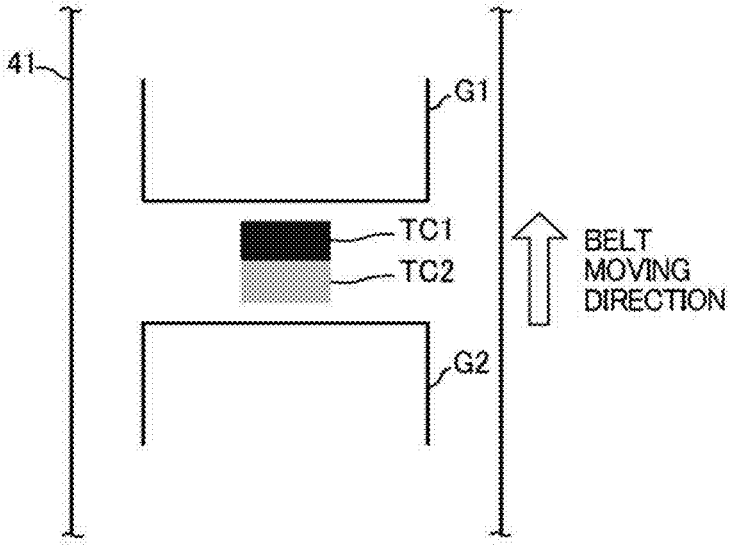
FIG. 25 is an explanatory diagram illustrating an example in the image density adjustment control during image formation in which two types of test toner images in one color are formed in each interval when a machine configuration includes only one optical sensor in the main scanning direction.
Figure 26:
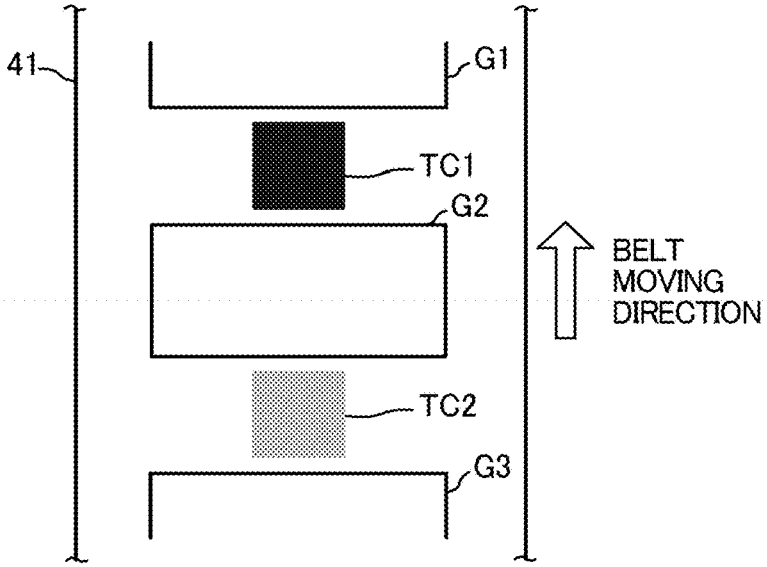
FIG. 26 is an explanatory diagram illustrating an example in the image density adjustment control during image formation in which one test toner image in one color is formed in each interval when a machine configuration includes only one optical sensor in the main scanning direction.

In the image forming apparatus having only one optical sensor 48 in the main scanning direction, for example, as illustrated in FIG. 25, the print controller 112 may create two types of test toner image of one color and control the optical sensor 48 to detect the toner adhesion amounts of the two types of test toner images for each color TY1, TC1, TM1, TK1, TY2, TC2, TM2, and TK2 sequentially. When the interval between sheets is too short in the sub-scanning direction to create the two types of the test toner images continuously in the sub-scanning direction, as illustrated in FIG. 26, the print controller 112 may create one test toner image in each interval between sheets and control the optical sensor 48 to detect the toner adhesion amounts of the two types of test toner images for each color TY1, TC1, TM1, TK1, TY2, TC2, TM2, and TK2 sequentially.

The optical sensors 48-1 to 48-4 detect the toner adhesion amounts of the two types of test toner images for each color TY1, TC1, TM1, TK1, TY2, TC2, TM2, and TK2 in step S52. In step S53, as in the above-described embodiment, the print controller 112 illustrated in FIG. 6 calculates the current solid image developing potential MaxPot based on the setting value of the charging bias Vc and the exposure intensity LDP when the test toner images for the solid image density TY1, TC1, TM1, and TK1 are created, using the developing potential estimation equation that is the above equation (7) calculated in the non-printing process. In step S54, the print controller 112 calculates the current solid image development γ1 using the calculated solid image developing potential MaxPot, the toner adhesion amount detection results (measured values) of the test toner images of solid image density by the optical sensors 48-1 to 48-4, and the development threshold voltage Vk obtained at the above process control.

After calculating the development γ1 for the solid image density in this manner, as in the above-described embodiment, the print controller 112 calculates the target solid image developing potential NewMaxPot to acquire the target toner adhesion amount for the solid image density using the calculated development γ1 for the solid image density and the development threshold voltage Vk in step S55. As a method of calculating the target solid image developing potential NewMaxPo, the same method as in the above-described embodiment may be used.

In step S56, in the first variation, the print controller 112 illustrated in FIG. 6 calculates the current halftone image developing potential HtPot based on the setting value of the charging bias Vc and the exposure intensity LDP when the test toner images for the halftone image density TY2, TC2, TM2, and TK2 are created, using the halftone image developing potential estimation equation that is the above equation (11) calculated in the non-printing process. In step S57, the print controller 112 calculates the current halftone image development γ2 using the calculated halftone image developing potential HtPot, the toner adhesion amount detection results (measured values) of the test toner images of halftone image density by the optical sensors 48-1 to 48-4, and the development threshold voltage Vk obtained at the above process control.

Figure 27:
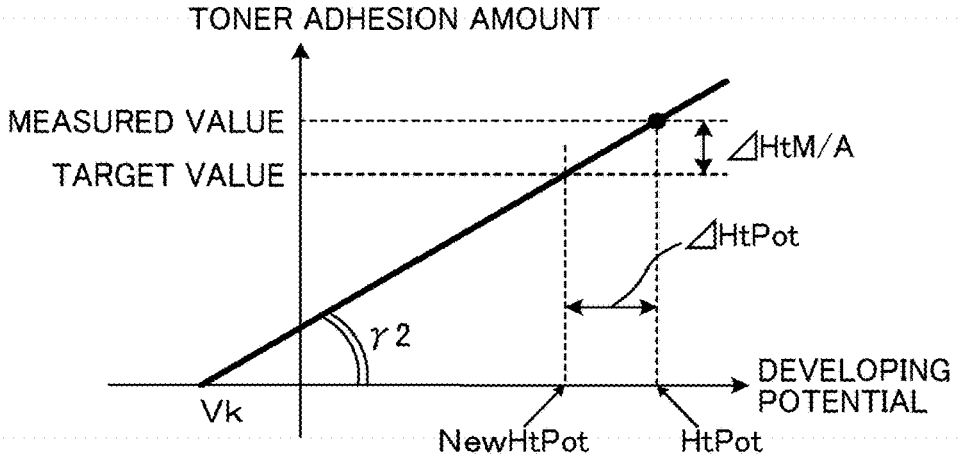
FIG. 27 is a graph illustrating estimation of a halftone development $\gamma 2$ obtained from a calculated halftone developing potential, a toner adhesion amount detection result of a halftone test toner image that is a measurement value, which are obtained by the image density adjustment control during printing, and a development threshold voltage obtained by process control.

FIG. 27 is a graph illustrating estimation of the halftone image development γ2 obtained from the calculated halftone image developing potential HtPot, the toner adhesion amount detection results (measured values) of the halftone test toner images TY2, TC2, TM2, and TK2 by the optical sensors 48-1 to 48-4, and the development threshold voltage Vk obtained at the above process control. In the graph, the horizontal axis indicates the developing potential, and the vertical axis indicates the toner adhesion amount. The print controller 112 draws a straight line connecting one point determined from the calculated halftone image developing potential HtPot and each of values measured by the optical sensors 48-1 to 48-4 and one point determined from the development threshold voltage Vk and calculates the inclination of this straight line as the halftone image development γ2.

After calculating the halftone image development γ2 in this manner, the print controller 112 calculates a target halftone image developing potential NewHtPot by using the calculated halftone image development γ2 and the development threshold voltage Vk to obtain a target toner adhesion amount for the halftone image density in step S58. This target toner adhesion amount is a toner adhesion amount necessary for obtaining the halftone image density corresponding to the image area rate of 50% and may be determined by experiments in advance or determined based on the toner adhesion amount detection result when the optical sensors 48-1 to 48-4 detect the gradation pattern created at the process control described above.

As a method of calculating the target halftone image developing potential NewHtPot, it is possible to adopt a method similar to the method of calculating the target solid image developing potential NewMaxPot in the above-described embodiment. That is, the print controller 112 firstly calculates a difference ΔM/A between the target halftone image toner adhesion amount and the toner adhesion amount detection result (measured value) of each of the halftone test toner images TY2, TC2, TM2, and TK2 detected by the optical sensors 48-1 to 48-4. Next, based on the calculated difference ΔM/A and the halftone image current development γ calculated in step S57, the print controller 112 calculates the difference ΔHtPot between the current halftone image developing potential HtPot calculated in step S56 and the target halftone image developing potential NewHtPot. Then, using the calculated difference ΔHtPot, the print controller 112 calculates the target halftone image developing potential NewHtPot from the current halftone image developing potential HtPot calculated in step S56.

After calculating the target solid image developing potential NewMaxPot and the target halftone image developing potential NewHtPot in this manner, the print controller 112 adjusts the setting value of the image forming condition in step S59. In the first variation, similarly to the above-described embodiment, the print controller 112 determines a setting value range of the charging bias Vc and the exposure intensity LDP from the calculated target solid image developing potential NewMaxPot by using the solid image developing potential estimation equation (above-described equation (7)) calculated in the non-printing process. That is, from the target developing potential NewMaxPot, the print controller 112 determines a range of the set of the charging bias Vc and the exposure intensity LDP satisfying the above equation (8).

Additionally, in the first variation, the print controller 112 determines a setting value range of the charging bias Vc and the exposure intensity LDP from the calculated target halftone image developing potential NewHtPot by using the halftone image developing potential estimation equation (above-described equation (11)) calculated in the non-printing process. That is, from the target halftone image developing potential NewHtPot, the print controller 112 determines the range of set of the charging bias Vc and the exposure intensity LDP satisfying the following equation (12). The set of the charging bias Vc and the exposure intensity LDP, which is determined from the target halftone image developing potential NewHtPot, is also represented as the graph illustrated in FIG. 19.

$$g2\{Vc,LDP\}=\text{New}Ht\text{Pot} \tag{12}$$

Subsequently, the print controller 112 determines a set of the charging bias Vc and the exposure intensity LDP that can obtain the target toner adhesion amounts for both the solid image density and the halftone image density based on the setting value range of the charging bias Vc and the exposure intensity LDP that can obtain the target solid image toner adhesion amount and the setting value range of the charging bias Vc and the exposure intensity LDP that can obtain the target halftone image toner adhesion amount. That is, the print controller 112 calculates the values of the charging bias Vc and the exposure intensity LDP which satisfy both of the above-mentioned equations (8) and (12). Specifically, the print controller 112 obtains a solution to simultaneous equations of the above-mentioned equations (8) and (12).

Figure 28:
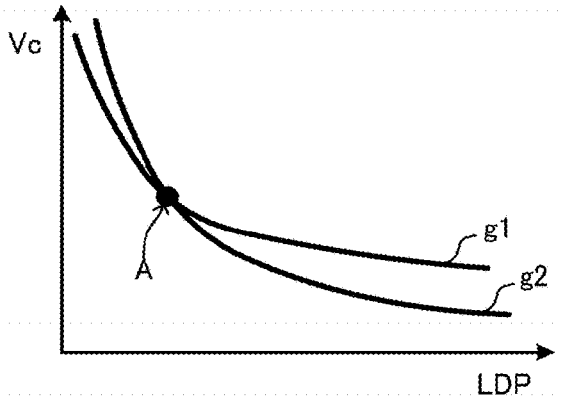
FIG. 28 is a graph for describing an example of a method for determining a value of a charging bias and an exposure intensity that can obtain a target toner adhesion amount for both solid image density and halftone image density.

FIG. 28 is a graph describing the charging bias Vc and the exposure intensity LDP which satisfy both above-mentioned equations (8) and (12).

In this graph, the vertical axis indicates the charging bias Vc, and the horizontal axis indicates the exposure intensity LDP. A curve g1 in the graph represents sets of the charging bias Vc and the exposure intensity LDP satisfying the equation (8), and a curve g2 in the graph represents sets of the charging bias Vc and the exposure intensity LDP satisfying the equation (12). The values of the charging bias Vc and the exposure intensity LDP that satisfy both of the expressions (8) and (12) are the values indicated by a point A on the graph of FIG. 28.

After determining the set of the charging bias Vc and the exposure intensity LDP as described above, the print controller 112 calculates the exposure potential VL from the charging bias Vc and the exposure intensity LDP by using the exposure potential estimation equation that is the above equation (4) calculated in the non-printing process. The print controller 112 also calculates the solid image developing potential MaxPot from the determined set of the charging bias Vc and the exposure intensity LDP using the developing potential estimation equation that is the above equation (7) calculated in the non-printing process. As described above, since the relation between the developing bias Vb and the solid image developing potential satisfies the relational expression of the developing bias Vb [−V]=the developing potential [−V]+the exposure potential VL [−V], the print controller 112 calculates the developing bias Vb based on the above equation (9).

After the print controller 112 calculates the setting value of the adjusted image formation condition such as the charging bias Vc, the exposure intensity LDP, and the developing bias Vb, the control device 100 controls the charger 5, the writing unit 20, and the developing unit 7 using the setting value to execute the image forming operation after that time.

In the first variation, two types of test toner images having different image densities are used, but three or more types of test toner images having different image densities may be used. However, when three or more types of test toner images are used, it is rare that the set of the charging bias Vc and the exposure intensity LDP that can obtain the target toner adhesion amount for each image density is uniquely determined. Therefore, for example, the print controller 112 firstly calculates a set of the charging bias Vc and the exposure intensity LDP that can obtain the target toner adhesion amount for each of the two types of image densities and may determine an average value or a median of calculated charging biases Vc and exposure intensities LDP as the adjusted charging bias Vc and exposure intensity LDP.

Figure 29:
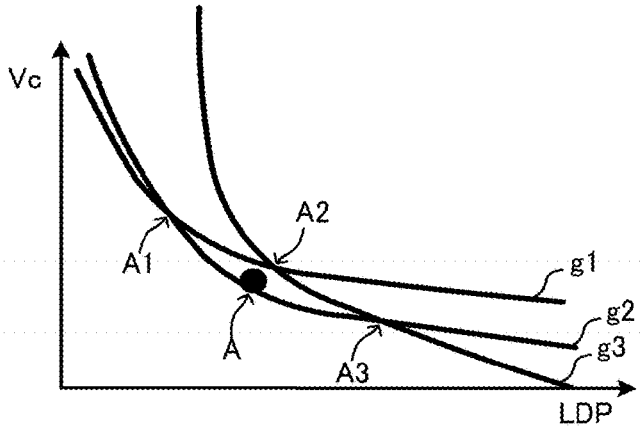
FIG. 29 is a graph for describing an example of another method for determining a value of a charging bias and an exposure intensity that can obtain a target toner adhesion amount for both solid image density and halftone image density.

FIG. 29 is a graph describing a method for determining the value of the charging bias Vc and the exposure intensity LDP that can obtain a target toner adhesion amount suitable for three types of image densities.

In this graph, the vertical axis indicates the charging bias Vc, and the horizontal axis indicates the exposure intensity LDP. A curve g1 in the graph represents sets of the charging bias Vc and the exposure intensity LDP satisfying the target toner adhesion amount of the solid image density. A curve g2 in the graph represents sets of the charging bias Vc and the exposure intensity LDP satisfying the target toner adhesion amount of the first halftone image density corresponding to the image area rate of 50%. A curve g3 in the graph represents sets of the charging bias Vc and the exposure intensity LDP satisfying the target toner adhesion amount of the second halftone image density corresponding to the image area rate of 30%.

A point A1 in the graph of FIG. 29 indicates a set of the charging bias Vc and the exposure intensity LDP that gives the target toner adhesion amounts for both the solid image density and the first halftone image density. A point A2 in the graph of FIG. 29 indicates a set of the charging bias Vc and the exposure intensity LDP that gives the target toner adhesion amounts for both the solid image density and the second halftone image density. A point A3 in the graph of FIG. 29 indicates a set of the charging bias Vc and the exposure intensity LDP that gives the target toner adhesion amounts for both the first halftone image density and the second halftone image density. A position of a point A in the graph of FIG. 29 indicates an average of these points A1 to A3. The print controller 112 determines the charging bias Vc and the exposure intensity LDP corresponding to the position of the point A as the adjusted setting value.

Second Variation

Next, a description is given below of an image density adjustment control during printing according to a second variation.

In the above-described embodiment, when the print controller 112 calculates the current development γ in the image density adjustment control during printing, the print controller 112 draws a straight line connecting one point determined from the calculated current developing potential MaxPot and each of values measured by the optical sensors 48-1 to 48-4 and one point determined from the development threshold voltage Vk and calculates the inclination of this straight line as the development γ. The development start voltage Vk used at this time is obtained at the process control, but this development start voltage Vk may not be a suitable value for calculating the current development γ in the image density adjustment control during printing.

Figure 30:
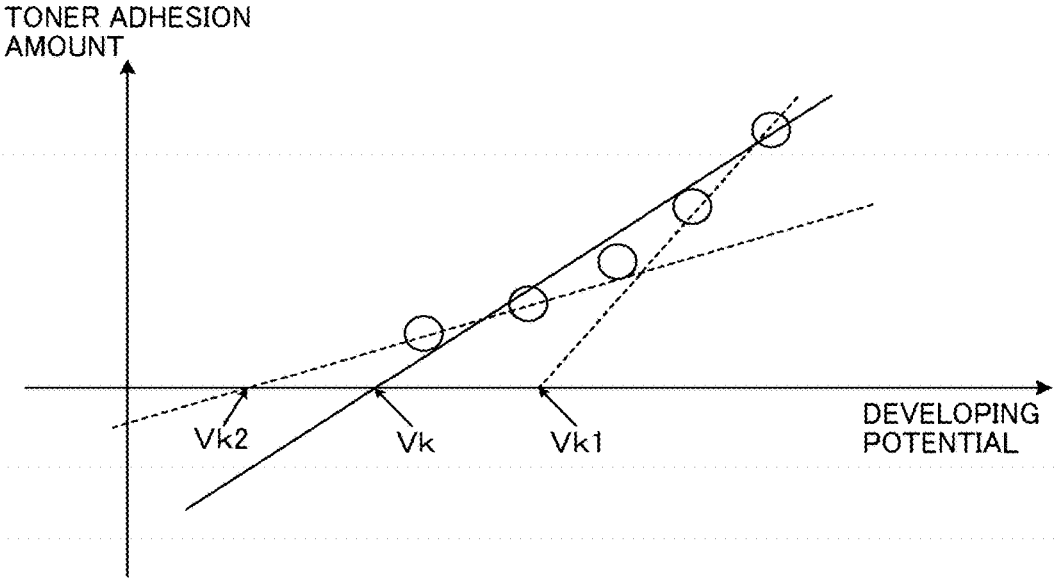
FIG. 30 is a graph illustrating an example of a relation between developing potential and toner adhesion amount in a gradation pattern created at the process control in a second variation.

FIG. 30 is a graph illustrating an example of a relation between the developing potential and the toner adhesion amount in the gradation pattern created at the process control.

At the process control, the process controller 111 derives the development threshold voltage Vk as x-intercept of a primary straight line determined by a primary linear equation approximating the relation between the developing potential and the toner adhesion amount in the gradation pattern created over a wide range of image density. However, the relation between the developing potential and the toner adhesion amount is not always constant from low image density to high image density. For example, the developer types, developer property, or the like may change the relation between the developing potential and the toner adhesion amount depending on image density range.

Therefore, for example, as illustrated in FIG. 30, the development threshold voltage Vk1 derived from the primary linear equation approximating the relation between the developing potential and the toner adhesion amount in the high image density region becomes different from the development threshold voltage Vk calculated in the process control. Similarly, the development threshold voltage Vk2 derived from the primary linear equation approximating the relation between the developing potential and the toner adhesion amount in the halftone image density region becomes different from the development threshold voltage Vk calculated in the process control.

When the relation between the developing potential and the toner adhesion amount is not constant over the range from the low image density to the high image density as described above, using the development threshold voltage Vk calculated in the process control to calculate the current development γ that is the solid image development γ may degrade the accuracy of the calculated current development γ.

Therefore, in the second variation, the non-print controller 113 not only acquires the potential data such as the exposure potential VL and the background portion potential Vd related to the adjustment pattern at the non-printing process, but also controls the optical sensors 48-1 to 48-4 to detect the toner adhesion amount when the adjustment pattern is developed, and obtains the development threshold voltage Vk obtained from the measurement value of each optical sensor. In the image density adjustment control during printing, the print controller 112 calculates the current development γ using the development threshold voltage Vk.

In the second variation, it is assumed that the test toner image created at the image density adjustment control during printing has the halftone image density corresponding to the image area rate of 50%, and the adjustment pattern created at the non-printing process also sets to have the same halftone image density as the test toner image.

Figure 31:
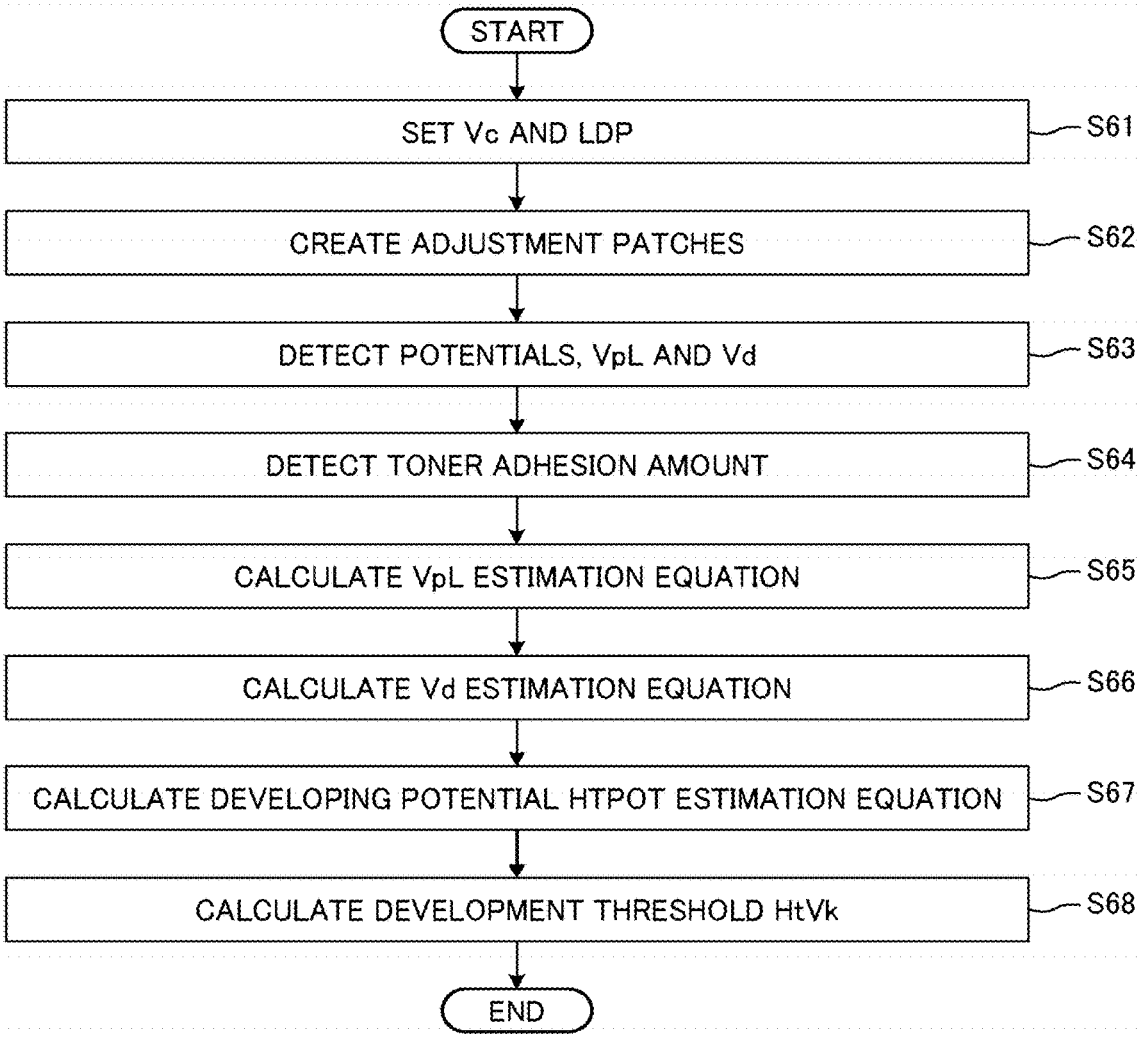
FIG. 31 is a flowchart illustrating the non-printing process according to the second variation.

FIG. 31 is a flowchart illustrating the non-printing process according to the second variation. This flowchart is an alternative to the flowchart illustrated in FIG. 13.

In the non-printing process of the second variation, as the above-described embodiment, firstly, the non-print controller 113 creates patches in the adjustment pattern for each color while changing the charging bias Vc and the exposure intensity LDP in steps S61 and S62, and the potential sensor 18 detects the halftone exposure potentials VpL and the background potentials Vd of the patches in step S63. Each patch in the adjustment pattern of the second variation is created by changing the charging bias Vc and the exposure intensity LDP to obtain, for example, the halftone image density corresponding to the image area rate of 50%.

In the second variation, the developing unit 7 develops the adjustment pattern created as described above, and the optical sensors 48-1 to 48-4 detect the toner adhesion amount of the adjustment pattern that is a toner pattern in step S64.

Subsequently, as in the above-described embodiment, based on the setting values of the charging biases Vc and the exposure intensities LDP when each adjustment patch is created and the detected halftone exposure potentials VpL, the non-print controller 113 calculates the VpL estimation equation to estimate the halftone exposure potential VpL as in the above-described equation (10), the Vd estimation equation to estimate the background portion potential Vd as in the above-described equation (5), and the halftone developing potential estimation equation to estimate the halftone image developing potential HtPot as in the above-described equation (11) in steps S65 to S67.

In the second variation, in step S68, the non-print controller 113 calculates the development threshold voltage HtVk from the detected toner adhesion amounts of the patches in the adjustment pattern with the halftone image density which is detected in step S64, the developing potential when the adjustment pattern is created, and the developing potential estimation equation as in the above-described equation (7). Specifically, in the graph in which the horizontal axis indicates the developing potential, and the vertical axis indicates the toner adhesion amount, the non-print controller 113 draws an approximate straight line based on a plurality of points determined from the detected toner adhesion amounts of the adjustment pattern with the halftone image densities and the halftone developing potentials when the adjustment pattern is created and calculates X-intercept of this approximate straight line as the development threshold voltage HtVk. The development threshold voltage HtVk calculated above is more suitable for the image density adjustment control during printing in which the test toner image is created with the halftone image density that is also the image density of the adjustment pattern in the non-printing process than the development threshold voltage Vk obtained at the process control.

In the second variation, the print controller 112 uses the development threshold voltage HtVk calculated above instead of the development threshold voltage Vk obtained at the process control to calculate the current development γ in the image density adjustment control during printing in step S34.

As in the above-described first variation, when the print controller 112 performs the image density adjustment control during printing using the two types of test toner images having a plurality of image densities such as the solid image density and the halftone image density, the print controller 112, for example, may use the development threshold voltage Vk calculated at the process control to calculate the solid image development γ1 and the development threshold voltage HtVk calculated in the second variation to calculate the halftone image development γ2. When experiment results show the small difference between the development threshold voltage Vk obtained at the process control and the development threshold voltage HtVk calculated in the non-printing process of the second variation that is suitable for the image density adjustment control during printing in which the test toner image is created with the halftone image density, the print controller 112 may use the development threshold voltage Vk obtained at the process control.

Third Variation

Next, a description is given below of an image density adjustment control during printing according to a third variation.

As in the above-described second variation, when the non-print controller 113 not only acquires the potential data such as the exposure potential VL and the background portion potential Vd related to the adjustment pattern at the non-printing process, but also controls the optical sensors 48-1 to 48-4 to detect the toner adhesion amount when the adjustment pattern is developed, the measurement error of the toner adhesion amount may be a problem.

As described above, the development gap fluctuation due to eccentricity of the photoconductor 3 and the developing roller 12 causes the periodic image density fluctuation. Therefore, the toner adhesion amount on the adjustment pattern shorter than the circumferential length of the photoconductor 3 and the circumference of the developing roller 12 in the sub-scanning direction varies depending on the timing of creating the adjustment pattern even if the same adjustment pattern is formed and developed. This may prevent the calculation of an appropriate development threshold voltage HtVk.

In the third variation, when the adjustment pattern is developed at the non-printing process and the toner adhesion amount is detected, the image density fluctuation control in the above-described embodiment is executed, and the adjustment pattern is developed. The image density fluctuation control cancels the toner adhesion amount fluctuation caused by the development gap fluctuation and reduces variation of the detected toner adhesion amount caused by different creation timing of the adjustment pattern. This enables calculation of the development threshold voltage Vk suitable for the non-printing process under the development gap fluctuation that may cause the periodic image density fluctuation.

However, in the image density fluctuation control according to the present embodiment, the exposure intensity is periodically changed to cancel the fluctuation of the toner adhesion amount. Therefore, when the potential data such as the halftone exposure potential VpL and the background portion potential Vd is acquired while executing the image density fluctuation control of the above-described embodiment, an appropriate developing potential estimation equation or the like cannot be calculated. Therefore, in the third variation, the non-print controller 113 creates the adjustment pattern without executing the image density fluctuation control and acquires the potential data of the adjustment pattern. After that, the non-print controller 113 executes the image density fluctuation control, creates the adjustment pattern, and acquires the toner adhesion amount of the adjustment pattern.

Figure 32:
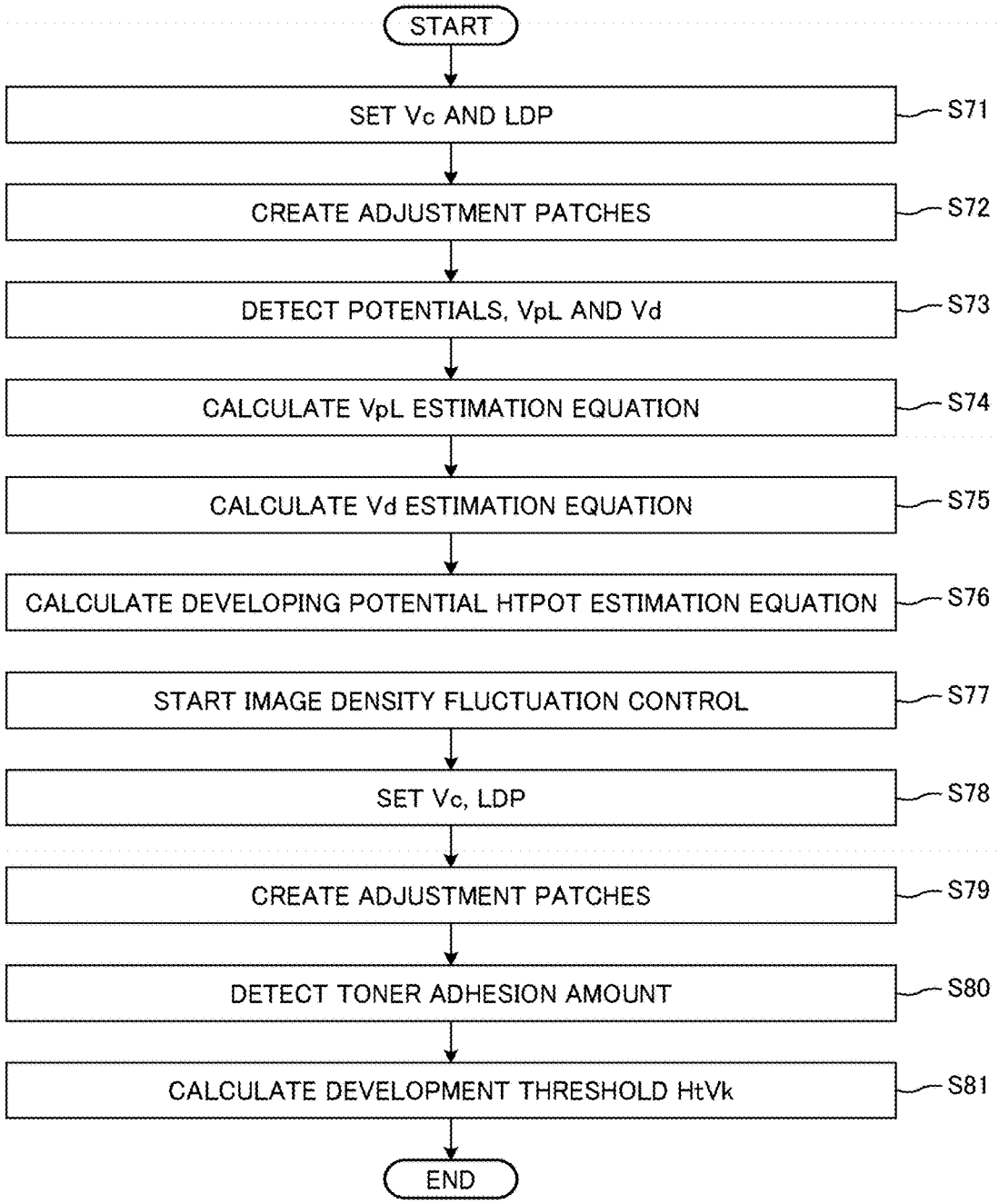
FIG. 32 is a flowchart illustrating the non-printing process according to the third variation.

FIG. 32 is a flowchart illustrating the non-printing process according to the third variation.

In the third variation, as the above-described second variation, firstly, the non-print controller 113 creates latent images regarding the adjustment patches with the halftone exposure potentials VpL and the background portion potentials Vd in steps S71 and S72 without executing the image density fluctuation control, and the potential sensor 18 detects the halftone exposure potentials VpL and the background potentials Vd of the adjustment patches in step S73.

Subsequently, the non-print controller 113 calculates the VpL estimation equation as in the above-described equation (10), the Vd estimation equation as in the above-described equation (5), and the halftone developing potential estimation equation as in the above-described equation (11) to estimate the halftone image developing potential HtPot in steps S74 to S76. It should be noted that the toner adhesion amount for this adjustment pattern is not measured.

Subsequently, the image density fluctuation controller starts the image density fluctuation control, and under the image density fluctuation control, the non-print controller 113 creates the latent images of the adjustment patches with the halftone exposure potentials VpL and the background portion potentials Vd as in the above-described second variation in steps S78 and S79, the developing unit 7 develops the adjustment patches of the adjustment pattern, and the optical sensors 48-1 to 48-4 measures the toner adhesion amount of the adjustment patches of the adjustment pattern in each color toner in step S80. After that, in step S81, the non-print controller in the third variation calculates the development threshold voltage HtVk from the toner adhesion amount measurement value of the adjustment pattern measured in step S80, the developing potential when the adjustment pattern is created and measured the toner adhesion amount, and the halftone developing potential estimation equation as in the above-described equation (11) calculated in step S76.

Since the adjustment pattern longer than the circumferential length of the photoconductor 3 and the developing roller 12 in the sub-scanning direction reduces the influence of the periodic image density fluctuation, the measurement of the toner adhesion amount of the adjustment pattern executing the image density fluctuation control as the third variation may not be needed. However, increasing the length of the adjustment pattern in the sub-scanning direction has a disadvantage of the long processing time of the non-printing process. In the third variation, the adjustment pattern is formed twice, but the length in the sub-scanning direction of the adjustment pattern is much shorter than the circumferential length of the photoconductor 3 and the circumference of the developing roller 12. Therefore, there is almost no disadvantage of the long processing time of the non-printing process.

If the image density fluctuation control does not affect the potential data such as the halftone exposure potential VpL and the background portion potential Vd of the adjustment pattern, for example, if the image density fluctuation control is a control in which periodically changing developing bias cancels the toner adhesion amount fluctuation, acquisition of suitable potential data is possible from the adjustment pattern created under the image density fluctuation control. In this case, the potential data and the toner adhesion amount can be acquired from the same adjustment pattern created by executing the image density fluctuation control.

Above description relates to the control regarding the halftone image density, but the control regarding the solid image density can be similarly performed.

Fourth Variation

Next, descriptions are given below of an image density adjustment control during printing according to a fourth variation.

In the image density adjustment control during printing of the embodiment described above, the control device 100 adjusts the setting values of the image forming conditions (the charging bias Vc, the exposure intensity LDP, and the developing bias Vb) based on the measurement result of the toner adhesion amount of the test toner image, but the adjustable range of each setting value has limitations. Therefore, when the calculated adjusted value exceeds the adjustable range, it is impossible to obtain the target image density only with the image forming conditions (the charging bias Vc, the exposure intensity LDP, and the developing bias Vb). In the fourth variation, when the calculated adjusted value exceeds the adjustable range, a target toner concentration that is a target output voltage Vtref of the toner concentration sensor 10 is adjusted.

Figure 33:
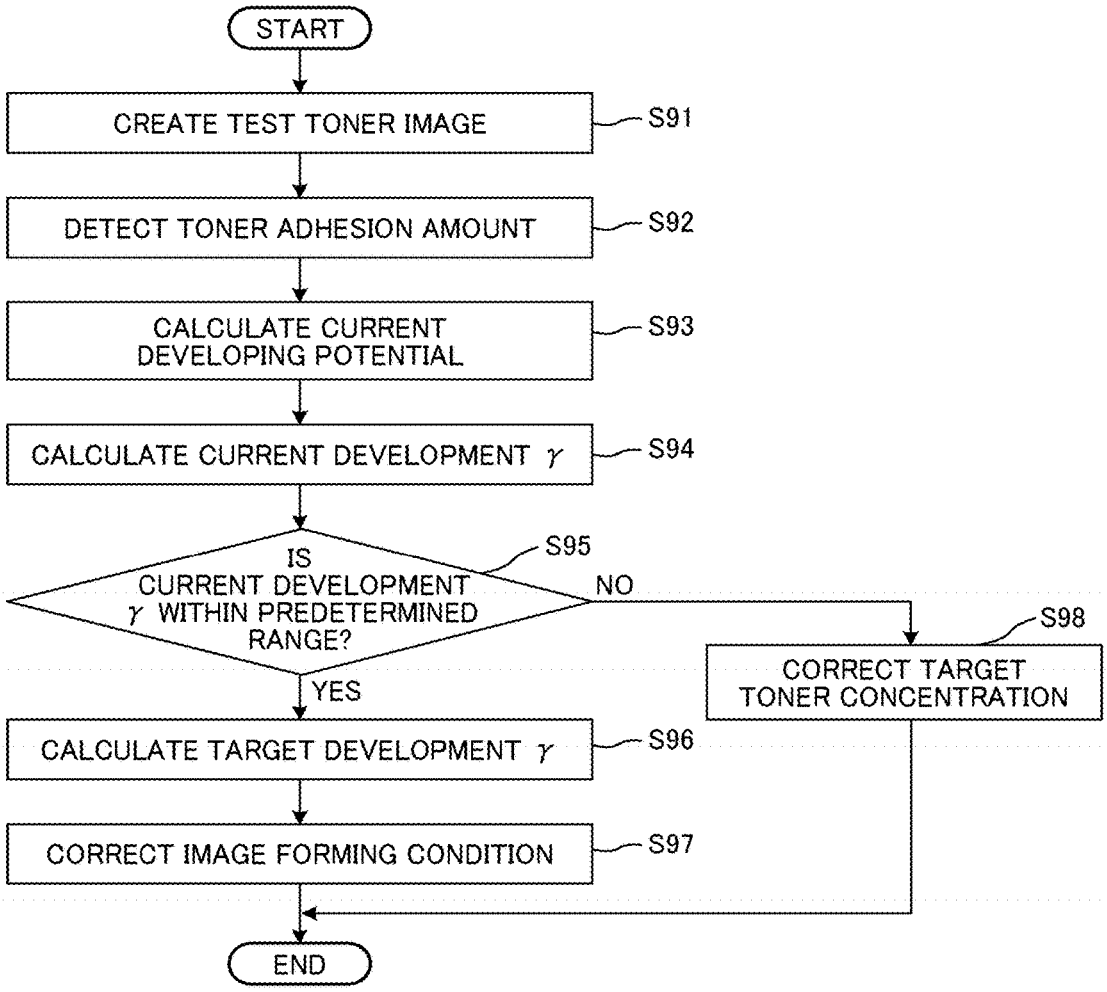
FIG. 33 is a flowchart illustrating the image density adjustment control during printing according to a fourth variation.

FIG. 33 is a flowchart illustrating the image density adjustment control during printing according to the fourth variation.

when a time of the image density adjustment control during printing comes, as in the above-described embodiment, at a predetermined timing, the print controller 112 creates test toner images of respective colors TY, TC, TM, and TK in the non-image forming area in step S91. The optical sensors 48-1 to 48-4 detect the toner adhesion amounts of the test toner images for each color in step S92. In step S93, the print controller 112 calculates the current developing potential MaxPot based on the setting values of the charging bias Vc and the exposure intensity LDP when the test toner images are created, using the developing potential estimation equation that is the above equation (7) calculated in the non-printing process. In step S94, the print controller 112 calculate the current development γ using the calculated developing potential MaxPot, the toner adhesion amount detection results (measured values) of the test toner images by the optical sensors 48-1 to 48-4, and the development threshold voltage Vk obtained at the above process control.

In the fourth variation, the print controller determines whether the setting values after adjustment on the image forming conditions (the charging bias Vc, the exposure intensity LDP, and the developing bias Vb) exceeds the adjustable range based on whether the development γ calculated in step S94 is within a predetermined range, that is, a predetermined adjustment range in step S95. When the calculated development γ is within the predetermined range (Yes in step S95), as in the above-described embodiment, the print controller 112 calculates the target developing potential NewMaxPot by using the calculated development γ and the development threshold voltage Vk to obtain a target toner adhesion amount in step S96. Then, based on the target developing potential NewMaxPot, the print controller 112 adjusts the setting values of the charging bias Vc, the exposure intensity LDP, and the developing bias Vb in step S97.

On the other hand, when the calculated development γ is out of the predetermined range (No in step S95), in the fourth variation, the target toner concentration Vtref is changed by a predetermined amount in step S98. For example, when the development γ is larger than the predetermined range, the target toner concentration Vtref is changed to be lowered, and when the development γ is smaller than the predetermined range, the target toner concentration Vtref is changed to be increased. This change results in an increase or decrease in the toner concentration in the developer in the developing unit 7 caused by a toner supply action after the change, resulting in a change in developing capacity, that is, a change in the development γ. The change in the development γ enables to change the image density in the same setting values of the charging bias Vc, the exposure intensity LDP, and the developing bias Vb. The change in the development γ enables adjustment of the development γ within the adjustable range of each setting value of the charging bias Vc, the exposure intensity LDP, and the developing bias Vb again.

Fifth Variation

Next, descriptions are given below of an image density adjustment control during printing according to a fifth variation.

Because a large adjustment amount in the setting value of the image forming condition before and after the image density adjustment control during printing causes a large change in the output image density, it is preferable to limit the adjustment amount to suppress the large change in the output image density. Therefore, in the fifth variation, a maximum adjustment amount is previously set for each image forming condition, that is, the charging bias Vc, the exposure intensity LDP, and the developing bias Vb, and when the adjustment amount exceeding the maximum adjustment amount is calculated, the print controller 112 adjusts the image forming condition so that the setting value is not adjusted beyond the maximum adjustment amount.

Figure 34:
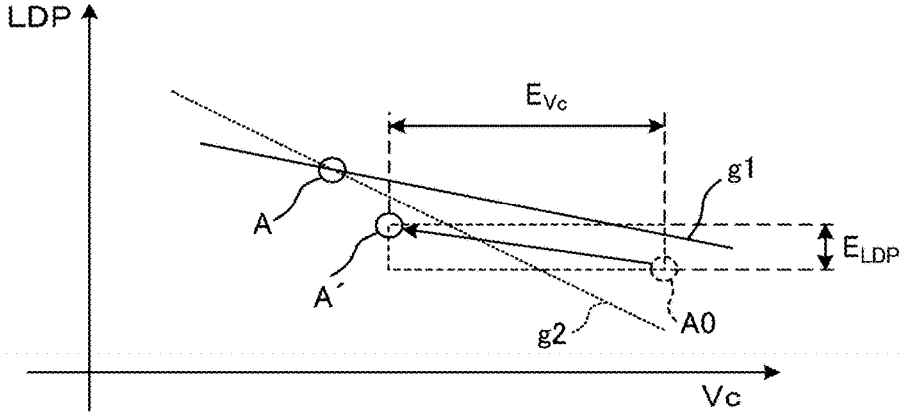
FIG. 34 is a graph illustrating an example of an adjustment method when the adjustment amount exceeding the maximum adjustment amount set in advance for the charging bias and the exposure intensity is calculated in a fifth variation.

FIG. 34 is a graph illustrating an example of an adjustment method when the adjustment amount exceeding the maximum adjustment amount EVC and ELDP set in advance for the charging bias Vc and the exposure intensity LDP is calculated.

In this graph, the vertical axis indicates the charging bias Vc, and the horizontal axis indicates the exposure intensity LDP. This graph is an enlarged graph near the point A in the graph illustrated in FIG. 28 according to the first variation described above. The coordinates of the point A are the charging bias Vc and the exposure intensity LDP which are adjusted to obtain the target toner adhesion amounts for the solid image density and the halftone image density. In FIG. 34, the adjustment exceeding the maximum adjustment amount means setting values of the charging bias Vc and the exposure intensity LDP to the target adjusted values A.

As illustrated in FIG. 34, simply adjusting the setting values of the charging bias Vc and the exposure intensity LDP by each maximum adjustment amount EVC and ELDP leads the setting values away from the graph g1 that represents the set of the charging bias Vc and the exposure intensity LDP satisfying the target toner adhesion amount of the solid image density than the setting values A0 before the adjustment. In this case, the adjusted solid image density deviates from the target image density, which may deteriorate the image quality.

Figure 35:
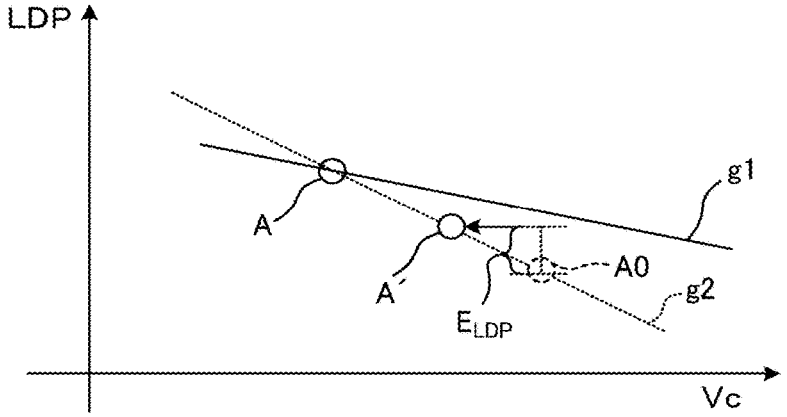
FIG. 35 is a graph illustrating another example of the adjustment method when the adjustment amount exceeding the maximum adjustment amount is calculated in the fifth variation.

FIG. 35 is a graph illustrating another example of the adjustment method when the adjustment amount exceeding the maximum adjustment amount is calculated.

In the example illustrated in FIG. 35, only the setting value of the exposure intensity LDP has the maximum adjustment amount ELDP. In this example, the adjustment exceeding the maximum adjustment amount ELDP is needed to setsetting values of the exposure intensity LDP to the target adjusted value A. In this case, after the print controller 112 adjusts the setting value of the exposure intensity LDP by the maximum adjustment amount ELDP, the print controller 112 selects either the solid image developing potential estimation equation as in the above-described equation (8) or the halftone image developing potential estimation equation as in the above-described equation (12) and calculates the charging bias Vc that satisfies the target toner adhesion amount of either the solid image density or the halftone image density based on the selected estimation equation and the setting value of the adjusted exposure intensity LDP to set the setting value of the charging bias Vc.

The method of selecting the estimation equation may be selected depending on which of the solid image density and the halftone image density is preferentially adjusted. However, the method of selecting the estimation equation for setting the charging bias Vc may be selected so that the deviation from the target toner adhesion amount for the solid image density and the halftone image density is not increased before and after the adjustment. In the example of FIG. 35, selection of the solid image developing potential estimation equation as in the above-described equation (8) leads deviation between the setting value of the charging bias Vc adjusted by the equation (8) and the setting value satisfying the target toner adhesion amount of the halftone image density greater than that before the adjustment. Therefore, in the case of the example of FIG. 35, the selection of the halftone developing potential estimation equation as in the above-described equation (12) enables setting the charging bias Vc that leads, at least, the halftone image density to the target image density and avoids deviation from the target solid image density after the adjustment greater than deviation from the target solid image density based on the setting values A0 before the adjustment. Repeating this adjustment leads the setting value of the charging bias Vc and the exposure intensity LDP to their target A after the image density adjustment control.

In the example described above, only the setting value of the exposure intensity LDP has the maximum adjustment amount ELDP, but only the setting value of the charging bias Vc may have the maximum adjustment amount Evc. In this case, after the print controller 112 adjusts the setting value of the charging bias Vc by the maximum adjustment amount Evc, the print controller 112 calculates the exposure intensity LDP that satisfies the target toner adhesion amount of the halftone image density based on the halftone developing potential estimation equation as in the above-described equation (12) and the setting value of the adjusted charging bias Vc to set the setting value of the exposure intensity LDP.

Figure 36:
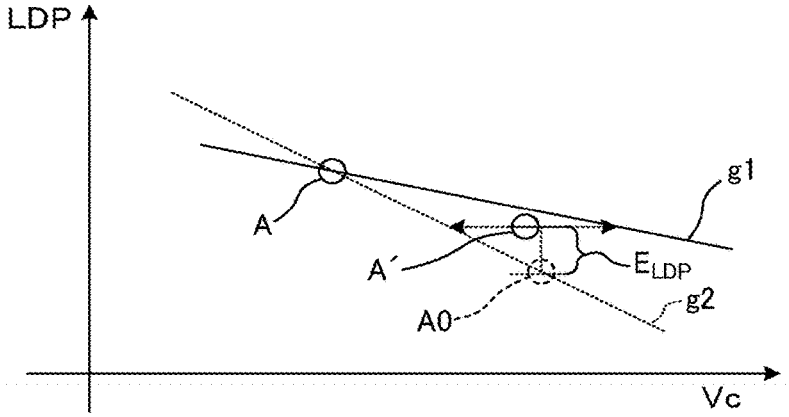
FIG. 36 is a graph illustrating still another example of the adjustment method when the adjustment amount exceeding the maximum adjustment amount is calculated in the fifth variation.

FIG. 36 is a graph illustrating still another example of the adjustment method when the adjustment amount exceeding the maximum adjustment amount is calculated.

In the example illustrated in FIG. 36, only the setting value of the exposure intensity LDP has the maximum adjustment amount ELDP, too. However, after adjusting the setting value of the exposure intensity LDP by the maximum adjustment amount, the print controller 112 adjusts the setting value of the charging bias Vc to the average value of a value Vc1 that gives the target toner adhesion amount for the solid image density and a value Vc2 that gives the target toner adhesion amount for the halftone image density.

In addition, as the adjustment method in the case where the maximum adjustment amount ELDP is provided for the setting value of the exposure intensity LDP, the following method may be used.

First, the control device 100 calculates a value Slope of Vc/LDP from the developing potential estimation equation as in the above-described equation (8) calculated in the non-printing process. If the developing potential estimation equation is a linear expression, the control device may obtain the inclination. If the developing potential estimation equation is a polynomial equation, for example, the control device 100 calculates Slope=Vc/LDP after partially differentiating the developing potential estimation equation with Vc or LDP using the charging bias Vc and the exposure intensity LDP before the adjustment. After that, when the target value after adjustment of the exposure intensity LDP is set as LDP_T, the adjustment amount ΔLDP of the exposure intensity LDP is calculated as ΔLDP=LDP_T−ELDP. Then, when ΔVc=Slope×ΔLDP and the target value after adjustment of the charging bias Vc is Vc_T, the adjustment amount of the charging bias Vc is determined as Vc_T−ΔVc.

In the example described above, only the setting value of the exposure intensity LDP has the maximum adjustment amount ELDP, but only the setting value of the charging bias Vc may have the maximum adjustment amount Evc.

Additionally, as in the above-described first variation, when the control device 100 calculates not only the solid image developing potential estimation equation as in the above-described equation (8) but also the halftone image developing potential estimation equation as in the above-described equation (12) at a calculation timing of the Slope, the control device 100 calculates Slope for the halftone image developing potential estimation equation similarly and calculates the average of the Slopes to adjust the setting values of the charging bias Vc and the exposure intensity LDP using the average.

The exemplary embodiments described above are one example and attain advantages below in a plurality of aspects A to K.

Aspect A

An image forming apparatus according to aspect A includes a latent image bearer, such as the photoconductor 3, an electrostatic latent image forming device, such as the charger 5 and the writing unit 20, to form a latent image on the latent image bearer, a potential sensor, such as the potential sensor 18, to detect a potential on the latent image bearer, a toner image forming device, such as the developing unit 7, to form the toner image based on the electrostatic latent image, a toner adhesion amount detector, such as the optical sensor 48-1 to 48-4, to detect a toner adhesion amount of the toner image, and circuitry, such as the control device 100. The circuitry controls the electrostatic latent image forming device to create an adjustment pattern on the latent image bearer during a non-printing period and controls the potential sensor to detect potential data, such as an exposure potential VL and a background portion potential Vd, of the adjustment pattern.

Additionally, the control device controls the toner image forming device and the electrostatic latent image forming device to create a test toner image, such as the test toner images TY, TC, TM, and TK, in an unused area, such as an interval on the latent image bearer during printing and controls the toner adhesion amount detector to detect a toner adhesion amount of the test toner image. The control device adjusts at least one image forming condition of a charging bias, such as the charging bias Vc, and an exposure intensity, such as the exposure intensity LDP, which are image forming conditions of the electrostatic latent image forming device, and a developing bias, such as the developing bias Vb, which is an image forming condition of the toner image forming device, based on the electric potential detected during the non-printing period and the toner adhesion amount detected during printing.

The control device according to the aspect A determines the image forming condition adjusted based on the toner adhesion amount detection result of the test toner images, such as the test toner images TY, TC, TM, and TK, created in the unused area using the potential data of the adjustment pattern created on the latent image bearer during the non-printing period.

The image density of the toner patch varies depending on the developing capacity expressed by the development γ, etc. even when the toner patch is created under the same image forming condition. Since the developing capacity depends on the characteristics of the developer such as a toner charge which is relatively liable to change, the developing capacity in the image density adjustment control during printing may be greatly different from the developing capacity in the image density adjustment control during the non-printing period.

If the control device sets the target image density in the image density adjustment control during printing based on the image density (ex. the solid image density) of the toner patch created and detected in the image density adjustment control during the non-printing period and adjusts the setting value of the image forming condition to decrease a difference between the target image density that is the image density of the toner patch detected in the image density adjustment control during the non-printing period and an image density of the test toner image created to be the same image density as the toner patch, there is a possibility that the setting value of the image forming condition is adjusted to an inappropriate value as the entire image, for example, the image density of the toner patch such as the solid image density is adjusted to the target image density, but another image density such as the halftone image density deviates from its target greatly because the image forming condition is adjusted without detecting the developing capacity at the time of the image density adjustment control during printing.

On the other hand, in the image density adjustment control during printing according to the aspect A, the developing capacity expressed by the development γ when the test toner image is created is calculated based on the potential data of the adjustment pattern acquired during the non-printing period and the toner adhesion amount of the test toner image detected during printing. Therefore, since the control device can adjust the image forming condition based on the developing capacity calculated as described above, it is possible to adjust the setting value of the image forming condition to an appropriate value as the entire image.

Aspect B

In aspect B, the image forming apparatus according to the aspect A includes the circuitry that adjusts toner concentration of the developer to develop the latent image on the latent image bearer when the parameter regarding the image forming condition adjustment such as the development γ falls outside a predetermined range.

As described in the fourth variation, even when adjustment of only the image forming conditions, such as the charging bias Vc, the exposure intensity LDP, and the developing bias Vb, cannot give the target image density, the image forming apparatus according to the aspect B can obtain the target image density by adjustment of the toner concentration.

Aspect C

In aspect C, the image forming apparatus according to the aspect A or B includes the circuitry that creates a plurality of test toner images of different image densities in an unused area on the latent image bearer and adjusts the image forming condition based on toner adhesion amount detection results of the plurality of test toner images.

According to the aspect C, as described in the first variation, the image forming apparatus can obtain the target image density for a plurality of image densities.

Aspect D

In aspect D, the image forming apparatus according to any one of the aspects A to C, the test toner image includes the solid test toner image.

According to the aspect D, the image forming apparatus can obtain the target solid image density.

Aspect E

In aspect E, the image forming apparatus according to any one of the aspects A to D, the test toner image includes the halftone test toner image.

According to the aspect E, the image forming apparatus can obtain the target halftone image density.

Aspect F

In aspect F, the image forming apparatus according to any one of the aspects A to E, the test toner image and the adjustment pattern includes at least one patch formed under a same electrostatic latent image condition.

Such a configuration simplifies processing because adjustment of the setting value of the image forming condition that uses the toner adhesion amount detection result of the test toner image in the image density adjustment control during printing can directly use the potential data of the adjustment pattern.

Aspect G

In aspect G, the image forming apparatus according to any one of the aspects A to F includes the control device that adjusts the setting value of the image forming condition also using the toner adhesion amount detection result of the developed adjustment pattern created on the latent image bearer during the non-printing period.

As described in the second variation, such a configuration can more appropriately adjust the setting value of the image forming condition in the image density adjustment control during printing.

Aspect H

In aspect H, the image forming apparatus according to the aspect F includes the circuitry that has an image density fluctuation controller, such as the image density fluctuation controller 114, to create a pattern for detecting an image density fluctuation, control the toner adhesion amount detector to detect a toner adhesion amount of the pattern for detecting the image density fluctuation, specify the image density fluctuation based on the detected toner adhesion amount, and execute an image density fluctuation control that varies the setting value of the image forming condition to reduce the image density fluctuation, and the circuitry adjusts the setting value of the image forming condition also using a detection result of the toner adhesion amount of the adjustment pattern created and developed on the latent image bearer while executing the image density fluctuation control during the non-printing period.

With such a configuration, as described in the third variation, the control device can obtain the toner adhesion amount detection result in which the image density fluctuation is reduced, thus allowing the setting value of the image forming condition to be more appropriately adjusted in the image density adjustment control during printing.

Aspect I

In aspect I, the image forming apparatus according to the aspect H includes the circuitry that adjusts the setting value of the image forming condition also using the electric potential of the adjustment pattern created on the latent image bearer without executing the image density fluctuation control during the non-printing period and the toner adhesion amount of the test toner image created and developed on the latent image bearer while executing the image density fluctuation control.

With such a configuration, as described in the third variation, the control device can obtain the toner adhesion amount detection result in which the image density fluctuation is reduced and appropriate potential data of the adjustment pattern even if the image density fluctuation control changes the setting value of the image forming condition that affects the potential data of the adjustment pattern. Accordingly, the control device can more appropriately adjust the setting value of the image forming condition in the image density adjustment control during printing.

Aspect J

In aspect J of the image forming apparatus according to any one of the aspects G to I, the length of the adjustment pattern in a direction of movement of the surface of the latent image bearer is longer than the circumferential length of the developer bearer such as the developing roller 12.

With such a configuration, the control device can obtain the toner adhesion amount detection result in which the image density fluctuation having the rotation period of the developer bearer is reduced, thus the setting value of the image forming condition to be more appropriately adjusted in the image density adjustment control during printing because.

Aspect K

In aspect K of the image forming apparatus according to any one of the aspects A to J, the length of the adjustment pattern in a direction of movement of the surface of the latent image bearer is longer than the circumferential length of the latent image bearer.

With such a configuration, the control device can obtain the toner adhesion amount detection result of the adjustment pattern in which the image density fluctuation having the rotation period of the latent image bearer is reduced and the potential data of the adjustment pattern in which a potential fluctuation having the rotation period of the latent image bearer is reduced. Accordingly, the control device can more appropriately adjust the setting value of the image forming condition in the image density adjustment control during printing The above-described embodiments and variations are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits. A processing circuit includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

Each of the functions of the described embodiments may be implemented by a computer program which is stored in a non-transitory recording medium such as the ROM or the RAM.

What is claimed is:

1. An image forming apparatus comprising:

a latent image bearer;

an electrostatic latent image forming device to form an electrostatic latent image on the latent image bearer;

a potential sensor to detect an electric potential on the latent image bearer;

a toner image forming device to form a toner image based on the electrostatic latent image;

a toner adhesion amount detector to detect a toner adhesion amount of the toner image; and circuitry configured to:

control the electrostatic latent image forming device to create an adjustment pattern on the latent image bearer during a non-printing period in which the image forming apparatus is not printing, control the potential sensor to detect an electric potential of the adjustment pattern, control the electrostatic latent image forming device and the toner image forming device to create a test toner image during a printing period, control the toner adhesion amount detector to detect a toner adhesion amount of the test toner image, and adjust at least one image forming condition of the electrostatic latent image forming device and the toner image forming device based on the electric potential of the adjustment pattern and the toner adhesion amount of the test toner image.

2. The image forming apparatus according to claim 1, wherein the toner image forming device includes a developing unit, and the circuitry adjusts toner concentration of a developer in the developing unit when a parameter regarding adjustment of the image forming condition falls outside a predetermined range.

3. The image forming apparatus according to claim 1, wherein the circuitry creates a plurality of test toner images of different image densities in an unused area on the latent image bearer and adjusts the image forming condition based on toner adhesion amounts of the plurality of test toner images.

4. The image forming apparatus according to claim 1, wherein the test toner image includes a solid image.

5. The image forming apparatus according to claim 1, wherein the test toner image includes a halftone image.

6. The image forming apparatus according to claim 1, wherein the test toner image and the adjustment pattern includes at least one patch formed under a same electrostatic latent image condition.

7. The image forming apparatus according to claim 1, wherein the circuitry adjusts the image forming condition also using a toner adhesion amount of the adjustment pattern created and developed on the latent image bearer during the non-printing period.

8. The image forming apparatus according to claim 7, wherein the circuitry creates a pattern for detecting an image density fluctuation, controls the toner adhesion amount detector to detect a toner adhesion amount of the pattern for detecting the image density fluctuation, specifies the image density fluctuation based on the detected toner adhesion amount, and executes an image density fluctuation control that varies a setting value of the image forming condition to reduce the image density fluctuation, and wherein the circuitry adjusts the setting value of the image forming condition also using a detection result of the toner adhesion amount of the adjustment pattern created and developed on the latent image bearer while executing the image density fluctuation control during the non-printing period.

9. The image forming apparatus according to claim 8, wherein the circuitry adjusts the setting value of the image forming condition also using:

the electric potential of the adjustment pattern created on the latent image bearer without executing the image density fluctuation control during the non-printing period, and the toner adhesion amount of the test toner image created and developed on the latent image bearer while executing the image density fluctuation control.

10. The image forming apparatus according to claim 7, wherein the toner image forming device includes a developer bearer, and a length of the adjustment pattern in a direction of movement of a surface of the latent image bearer is equal to or longer than a circumferential length of the developer bearer.

11. The image forming apparatus according to claim 1, wherein a length of the adjustment pattern in a direction of movement of a surface of the latent image bearer is equal to or longer than a circumferential length of the latent image bearer.

12. An image forming method for an image forming apparatus, comprising:

creating, with an electrostatic latent image forming device of the image forming apparatus, an adjustment pattern on a latent image bearer of the image forming apparatus during a non-printing period in which the image forming apparatus is not printing;

detecting, with a potential sensor of the image forming apparatus, an electric potential of the adjustment pattern;

creating, with the electrostatic latent image forming device and a toner image forming device of the image forming apparatus, a test toner image during printing;

detecting, with a toner adhesion amount detector of the image forming apparatus, a toner adhesion amount of the test toner image; and adjusting, with circuitry of the image forming apparatus, at least one image forming condition of the electrostatic latent image forming device and the toner image forming device based on the electric potential and the toner adhesion amount.

13. A non-transitory recording medium including a program that causes an image forming apparatus to execute an image forming method, comprising:

creating, with an electrostatic latent image forming device of the image forming apparatus, an adjustment pattern on a latent image bearer of the image forming apparatus during a non-printing period in which the image forming apparatus is not printing;

detecting, with a potential sensor of the image forming apparatus, an electric potential of the adjustment pattern;

creating, with the electrostatic latent image forming device and a toner image forming device of the image forming apparatus, a test toner image during printing;

detecting, with a toner adhesion amount detector of the image forming apparatus, a toner adhesion amount of the test toner image; and adjusting, with circuitry of the image forming apparatus, at least one image forming condition of the electrostatic latent image forming device and the toner image forming device based on the electric potential and the toner adhesion amount.

* * * * *